US011697184B2

(12) United States Patent
Kashiwagi et al.

(10) Patent No.: US 11,697,184 B2
(45) Date of Patent: Jul. 11, 2023

(54) SUBSTRATE PROCESSING APPARATUS AND SUBSTRATE PROCESSING METHOD

(71) Applicant: EBARA CORPORATION, Tokyo (JP)

(72) Inventors: Makoto Kashiwagi, Tokyo (JP); Manao Hoshina, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 190 days.

(21) Appl. No.: 16/748,606

(22) Filed: Jan. 21, 2020

(65) Prior Publication Data

US 2020/0246939 A1 Aug. 6, 2020

(30) Foreign Application Priority Data

Feb. 1, 2019 (JP) ..... 2019-016830

(51) Int. Cl.
*B24B 49/12* (2006.01)
*B24B 41/06* (2012.01)
(Continued)

(52) U.S. Cl.
CPC ..... *B24B 49/12* (2013.01); *B24B 7/228* (2013.01); *B24B 41/005* (2013.01); *B24B 41/06* (2013.01)

(58) Field of Classification Search
CPC ..... B24B 49/12; B24B 7/228; B24B 7/04; B24B 41/005; B24B 41/06; B24B 37/042; B24B 37/10; B24B 37/005; B24B 37/30; B24B 37/34; B24B 37/04; B24B 37/32; B24B 21/04; B24B 47/20; H01L 21/67259; H01L 21/67092; H01L 21/68;
(Continued)

(56) References Cited

U.S. PATENT DOCUMENTS 6,298,280 B1 * 10/2001 Bonora ..... H01L 21/681 414/941
9,248,545 B2 * 2/2016 Seki ..... B24B 49/12
(Continued)

FOREIGN PATENT DOCUMENTS

JP 2009-154285 A 7/2009
JP 2010-067905 A 3/2010
(Continued)

*Primary Examiner* — Joel D Crandall
*Assistant Examiner* — Michael A Gump
(74) *Attorney, Agent, or Firm* — BakerHostetler

(57) ABSTRACT

There is disclosed a substrate processing apparatus which can align a center of a substrate with a central axis of a process stage with high accuracy to prevent a defective substrate from being produced. The substrate processing apparatus includes: an eccentricity detecting mechanism configured to obtain an amount of eccentricity and an eccentricity direction of a center of the substrate, held on the centering stage, from a central axis of the centering stage; and an aligner configured to align the center of the substrate with a central axis of a process stage. The aligner obtains, after the substrate is transferred from the centering stage to the process stage, an amount of eccentricity and an eccentricity direction of the center of the substrate from the central axis of the process stage by use of the eccentricity detecting mechanism; and confirms that the obtained amount of eccentricity of the center of the substrate from the central axis of the process stage is within a predetermined allowable range.

22 Claims, 25 Drawing Sheets

(51) Int. Cl.
*B24B 41/00* (2006.01)
*B24B 7/22* (2006.01)

(58) Field of Classification Search
CPC ..... H01L 21/68764; H01L 21/68742; H01L 21/681; H01L 21/682; H01L 22/12
USPC ..... 451/5, 6
See application file for complete search history.

(56) References Cited

U.S. PATENT DOCUMENTS

| | | | | |
|---|---|---|---|---|
| 10,458,020 | B2 * | 10/2019 | Ishii | C23C 16/52 |
| 2009/0215246 | A1 * | 8/2009 | Kitahara | B23K 26/0624 257/E21.001 |
| 2010/0171823 | A1 * | 7/2010 | Yamamoto | H01L 21/681 348/95 |
| 2014/0273749 | A1 * | 9/2014 | Qian | B24B 35/005 451/5 |
| 2015/0104620 | A1 | 4/2015 | Takahashi | |
| 2015/0104999 | A1 | 4/2015 | Seki et al. | |
| 2016/0293471 | A1 * | 10/2016 | Shang | H01L 21/67259 |
| 2016/0305022 | A1 | 10/2016 | Ishii et al. | |
| 2021/0050243 | A1 * | 2/2021 | Otsuka | H01L 21/6838 |

FOREIGN PATENT DOCUMENTS

| | | | | |
|---|---|---|---|---|
| JP | 2010-182966 | A | 8/2010 | |
| JP | 2015-074071 | A | 4/2015 | |
| JP | 2015-195328 | A | 11/2015 | |
| JP | 2016-201535 | | 12/2016 | |
| JP | 2016201535 | A * | 12/2016 | B24B 37/00 |
| JP | 6113624 | B2 | 4/2017 | |

* cited by examiner

SUBSTRATE PROCESSING APPARATUS AND SUBSTRATE PROCESSING METHOD

CROSS REFERENCE TO RELATED APPLICATION

This document claims priority to Japanese Patent Application Number 2019-016830 filed Feb. 1, 2019, the entire contents of which are hereby incorporated by reference.

BACKGROUND

A polishing apparatus provided with a polishing tool, such as a polishing tape or a grinding stone, is used as an apparatus for polishing a peripheral portion of a substrate, such as a wafer. FIG. 35 is a schematic view of a polishing apparatus of this type. As shown in FIG. 35, the polishing apparatus includes a substrate stage 210 for holding a central area of a wafer W by vacuum suction and rotating the wafer W, and a polishing head 205 for pressing a polishing tool 200 against a peripheral portion of the wafer W. The wafer W is rotated together with the substrate stage 210 while the polishing head 205 presses the polishing tool 200, whose lower surface (polishing surface) is parallel to a surface of the wafer W, against a peripheral portion of the wafer W, thereby polishing the peripheral portion of the wafer W. A polishing tape or a whetstone may be used as the polishing tool 200.

As shown in FIG. 36, a width of a portion, to be polished by the polishing tool 200, of the wafer W (hereinafter referred to as a polishing width) is determined by a relative position of the polishing tool 200 with respect to the wafer W. The polishing width is typically a few millimeters from an outermost perimeter of the wafer W. In order to polish a peripheral portion of the wafer W with a constant polishing width, it is necessary to align a center of the wafer W with the central axis of the substrate stage 210.

Therefore, the conventional polishing apparatus has a centering stage for performing centering of the wafer W, a process stage for polishing the wafer W, and an aligner for aligning the center of the wafer W with a central axis the process stage (for example, see Japanese Patent Publication No. 6113624, and Japanese laid-open patent publication No. 2016-201535).

The aligner described in Japanese Patent Publication No. 6113624 is constituted of an eccentricity detector configured to measure an amount of eccentricity and an eccentricity direction (i.e., a maximum eccentric point on the wafer W) of a center of the wafer W, held on the centering stage, from a central axis of the centering stage, a centering-stage rotating mechanism configured to rotate the centering stage about an axis of the centering stage, and a moving mechanism configured to move the centering stage horizontally relative to the process stage.

This polishing apparatus, at first, moves the centering stage, in a state where a central axis of the process stage coincide with the central axis of the centering stage, to an elevated position higher than the process stage. Thereafter, the wafer W is held on the centering stage, and further, the centering stage and the wafer W are rotated by the centering-stage rotating mechanism. The eccentricity detector determines the amount of eccentricity of the center of the wafer W from the central axis of the centering stage, and the maximum eccentric point on the wafer W during rotating of the wafer W.

Next, the centering-stage rotating mechanism rotates the centering stage and the wafer W until a line interconnecting the maximum eccentric point and the central axis of the centering stage coincides with a predetermined offset axis of the moving mechanism. Next, the moving mechanism moves the centering stage and the wafer held on the centering stage along the offset axis by a distance corresponding to the amount of eccentricity measured by the eccentricity detector. Thus, the center of the wafer W can be aligned with the center of the process stage. Finally, the centering stage is lowered in a vertical direction to transfer the wafer W from the centering stage to the process stage, and then a peripheral portion of the wafer W held on the process stage is polished.

The aligner described in Japanese laid-open patent publication No. 2016-201535 performs centering of a wafer W under a condition where the central axis of the centering stage does not coincide with a central axis of the process stage. This aligner, at first, obtains an initial relative position of the central axis of the centering stage with respect to the central axis of the process stage. The aligner calculates a distance by which the centering stage is to be moved and an angle through which the centering stage is to be rotated, based on this initial relative position, and an amount of eccentricity and an eccentricity direction of the center of the wafer from the central axis of the centering stage, and then moves and rotates the centering stage by the calculated distance and through the calculated angle. Thus, the center of the wafer W can be aligned with the center of the process stage even under a condition where the central axis of the centering stage does not coincide with the central axis of the process stage.

Polishing of the peripheral portion of the wafer W by use of the polishing tool is performed on the wafer W held on the process stage. Accordingly, in order to polish the peripheral portion of the wafer W with an accurate polishing width, the amount of eccentricity of the center of the wafer W from the central axis of the process stage is most important. However, a conventional polishing apparatus does not measure the amount of eccentricity of the center of the wafer W from the central axis of the process stage after the wafer W is transferred from the centering stage to the process stage.

Accordingly, if the wafer W becomes displaced with respect to the process stage when the wafer is transferred from the centering stage to the process stage, the center of the wafer W is deviated from the central axis of the process stage. Further, if the centering-stage rotating mechanism and the moving mechanism are damaged and/or failed, the wafer W may be transferred from the centering stage to the process stage under a condition where the center of the wafer W is be deviated from the central axis of the process stage. Further, if there is an error in the algorithm (for example, a bug in a program) for calculating the amount of eccentricity and the eccentricity direction of the center of the wafer W from the central axis of the centering stage, the amount of eccentricity and the eccentricity direction determined by the eccentricity detector may be incorrect. If the amount of eccentricity and the eccentricity direction obtained by the eccentricity detector are incorrect, the center of the wafer W cannot be accurately aligned with the central axis of the process stage.

When the peripheral portion of the wafer W is polished under a condition where the center of the wafer W is not aligned with the central axis of the process stage, defective wafer (defective substrate) which exceeds an allowable polishing width may be produced. The problem that substrate processing is performed in the condition where a center of a substrate is not aligned with a central axis of a process stage, causing defective substrate to be produced, occurs also in another apparatus and method (for example, an apparatus and method for CVD, and an apparatus and method for sputtering) in which the substrate is processed while holding the substrate.

SUMMARY OF THE INVENTION

According to embodiments, there are provided a substrate processing apparatus and a substrate processing method which can align a center of a substrate, such as a wafer, with a central axis of a process stage with high accuracy, thereby preventing defective substrate from being produced.

Embodiments, which will be described below, relate to a substrate processing apparatus and a substrate processing method which are applicable to a polishing apparatus and a polishing method for polishing a peripheral portion of a substrate, such as a wafer.

In an embodiment, there is provided a substrate processing apparatus comprising: a centering stage configured to hold a first area of a lower surface of a substrate; a process stage configured to hold a second area of the lower surface of the substrate; a stage elevating mechanism configured to move the centering stage between an elevated position higher than the process stage and a lowered position lower than the process stage; a process-stage rotating mechanism configured to rotate the process stage about its central axis; an eccentricity detecting mechanism configured to obtain an amount of eccentricity and an eccentricity direction of a center of the substrate, when held on the centering stage, from a central axis of the centering stage; and an aligner configured to perform a centering operation for aligning the center of the substrate with a central axis of the process stage based on the amount of eccentricity and the eccentricity direction of the center of the substrate, held on the centering stage, from the central axis of the centering stage, wherein the aligner obtains, after the substrate is transferred from the centering stage to the process stage and held on the process stage, an amount of eccentricity and an eccentricity direction of the center of the substrate, held on the process stage, from the central axis of the process stage by use of the eccentricity detecting mechanism; and confirms that the obtained amount of eccentricity of the center of the substrate from the central axis of the process stage is within a predetermined allowable range.

In an embodiment, the aligner repeats the centering operation when the obtained amount of eccentricity of the center of the substrate from the central axis of the process stage is out of the predetermined allowable range.

In an embodiment, the eccentricity detecting mechanism includes an eccentricity detector configured to measure the amount of eccentricity and the eccentricity direction of the center of the substrate, held on the centering stage, from the central axis of the centering stage, and the amount of eccentricity and the eccentricity direction of the center of the substrate, held on the process stage, from the central axis of the process stage, the eccentricity detector is an optical eccentricity sensor which includes a light emitting section for emitting light, and a light receiving section for receiving the light emitting from the light emitting section, and a distance between the light emitting section and the light receiving section in a vertical direction is set so as to be greater than a distance between an upper surface of the substrate held on the centering stage which is located at an eccentricity detecting position and a periphery of the process stage.

In an embodiment, the eccentricity detecting mechanism includes an eccentricity detector configured to measure the amount of eccentricity and the eccentricity direction of the center of the substrate, held on the centering stage, from the central axis of the centering stage, and the amount of eccentricity and the eccentricity direction of the center of the substrate, held on the process stage, from the central axis of the process stage, and the eccentricity detector includes an imaging device and a light projector for emitting light toward the imaging device.

In an embodiment, the aligner includes: a centering-stage rotating mechanism configured to rotate the centering stage until the eccentricity direction of the center of the substrate, held on the centering stage, from the central axis of the centering stage is parallel to a predetermined offset axis extending in a horizontal direction; and a moving mechanism configured to move the centering stage along the predetermined offset axis until the center of the substrate held on the centering stage is located on the central axis of the process stage.

In an embodiment, the aligner performs a centering preparation operation for obtaining an initial relative position of the central axis of the centering stage with respect to the central axis of the process stage by use of the eccentricity detecting mechanism, and performs the centering operation based on the initial relative position, and based on the amount of eccentricity and the eccentricity direction of the center of the substrate, held on the centering stage, from the central axis of the centering stage.

In an embodiment, the aligner includes: a centering-stage rotating mechanism configured to rotate the centering stage until the center of the substrate on the centering stage is located on a straight line which extends through the central axis of the process stage and extends parallel to a predetermined offset axis; and a moving mechanism configured to move the centering stage along the predetermined offset axis until the center of the substrate held on the centering stage is located on the central axis of the process stage.

In an embodiment, the aligner further includes an operation controller for controlling operations of the moving mechanism and the centering-stage rotating mechanism, the operation controller includes: a memory in which a learned model constructed by machine learning is stored; and a processing device configured to perform operation to output an amount of movement and an amount of rotation of the centering stage for aligning the center of the substrate with the central axis of the process stage, when the amount of eccentricity and the eccentricity direction of the center of the substrate, held on the centering stage, from the central axis of the centering stage is inputted into the learned model.

In an embodiment, the aligner further includes an operation controller for controlling operations of the moving mechanism and the centering-stage rotating mechanism, the operation controller includes: a memory in which a learned model constructed by machine learning is stored; and a processing device configured to perform operation to output an amount of movement and an amount of rotation of the centering stage for aligning the center of the substrate with the central axis of the process stage, when the initial relative position and the amount of eccentricity and the eccentricity direction of the center of the substrate, held on the centering stage, from the central axis of the centering stage is inputted into the learned model.

In an embodiment, there is provided a substrate processing method comprising: holding a first area of a lower surface of a substrate with a centering stage; obtaining an amount of eccentricity and an eccentricity direction of a center of the substrate, when held on the centering stage, from a central axis of the centering stage; performing a centering operation for aligning the center of the substrate with a central axis of a process stage, based on the amount of eccentricity and the eccentricity direction of the center of the substrate, held on the centering stage, from the central axis of the centering stage; transferring the substrate from the centering stage to the process stage to be held on the process stage; obtaining an amount of eccentricity and an eccentricity direction of the center of the substrate, held on the process stage, from the central axis of the process stage; confirming that the obtained amount of eccentricity of the center of the substrate from the central axis of the process stage is within a predetermined allowable range; and processing the substrate while rotating the processing stage about its central axis, when the obtained amount of eccentricity of the center of the substrate from the central axis of the process stage is within the predetermined allowable range.

In an embodiment, the centering operation is repeated when the obtained amount of eccentricity of the center of the substrate from the central axis of the process stage is out of the predetermined allowable range.

In an embodiment, obtaining the amount of eccentricity and the eccentricity direction of the center of the substrate, held on the centering stage, from the central axis of the centering stage, and obtaining the amount of eccentricity and the eccentricity direction of the center of the substrate, held on the process stage, from the central axis of the process stage are performed by an eccentricity detector which is an optical eccentricity sensor including a light emitting section for emitting light, and a light receiving section for receiving the light emitting from the light emitting section; and a distance between the light emitting section and the light receiving section in a vertical direction is set so as to be greater than a distance between an upper surface of the substrate held on the centering stage and a periphery of the process stage.

In an embodiment, obtaining the amount of eccentricity and the eccentricity direction of the center of the substrate, held on the centering stage, from the central axis of the centering stage, and obtaining the amount of eccentricity and the eccentricity direction of the center of the substrate, held on the process stage, from the central axis of the process stage are performed by an eccentricity detector which includes an imaging device and a light projector for emitting light toward the imaging device.

In an embodiment, the centering operation includes: an operation of rotating the centering stage until the eccentricity direction of the center of the substrate, held on the centering stage, from the central axis of the centering stage is parallel to a predetermined offset axis extending in a horizontal direction; and an operation of moving the centering stage along the predetermined offset axis until the center of the substrate held on the centering stage is located on the central axis of the process stage.

In an embodiment, the substrate processing method further comprising: before the centering operation, performing a centering preparation operation for obtaining an initial relative position of the central axis of the centering stage with respect to the central axis of the process stage, wherein the centering operation is performed based on the initial relative position, and based on the amount of eccentricity and the eccentricity direction of the center of the substrate, held on the centering stage, from the central axis of the centering stage.

In an embodiment, the centering operation includes: an operation of rotating the centering stage until the center of the substrate on the centering stage is located on a straight line which extends through the central axis of the process stage and extends parallel to a predetermined offset axis; and an operation of moving the centering stage along the predetermined offset axis until a distance between the central axis of the centering stage and the central axis of the processing stage becomes equal to the amount of eccentricity.

In an embodiment, the amount of eccentricity and the eccentricity direction of the center of the substrate, held on the centering stage, from the central axis of the centering stage are inputted into a learned model constructed by machine learning, and an amount of rotation and an amount of movement of the centering stage for aligning the center of the substrate with the central axis of the process stage are outputted from the learned model.

In an embodiment, the initial relative position and the amount of eccentricity and the eccentricity direction of the center of the substrate, held on the centering stage, from the central axis of the centering stage are inputted into a learned model constructed by machine learning, and an amount of rotation and an amount of movement of the centering stage for aligning the center of the substrate with the central axis of the process stage are outputted from the learned model.

According to the above-described embodiments, the aligner confirms whether or not the center of the substrate transferred from the centering stage to the process stage is aligned with the central axis of the process stage with high accuracy. As a result, the defective substrate (for example, substrate which has been polished beyond the allowable polishing width) can be prevented from being produced.

DESCRIPTION OF EMBODIMENTS

Embodiments will now be described with reference to the drawings. Below-described embodiments of a substrate processing apparatus and a substrate processing method relate to a polishing apparatus and a polishing method for polishing a peripheral portion of a substrate.

Figure 1:
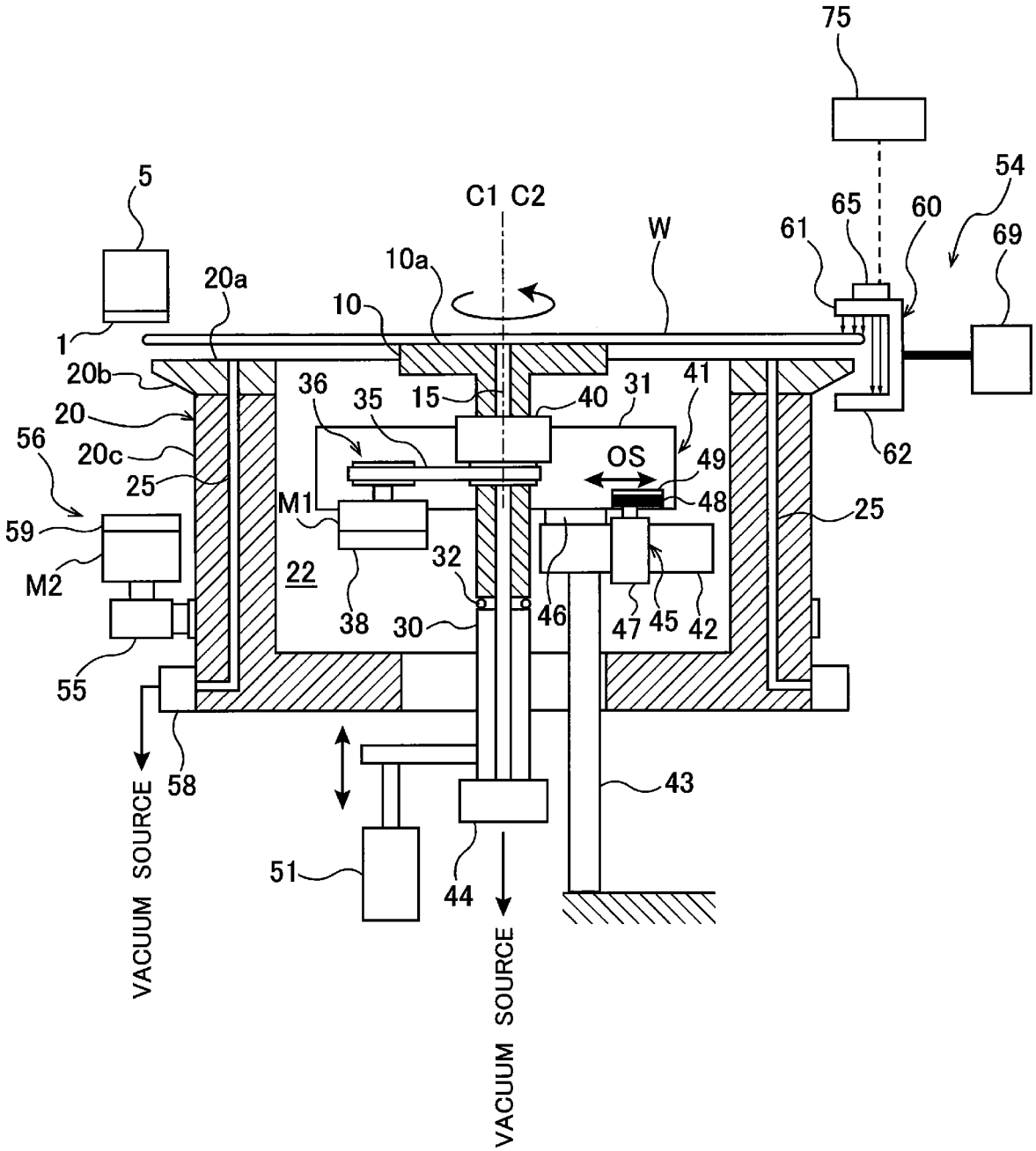
FIG. 1 is a schematic view showing a polishing apparatus according to an embodiment.

FIG. 1 is a schematic view of a polishing apparatus according to an embodiment. As shown in FIG. 1, the polishing apparatus includes a centering stage 10 and a process stage 20, both of which are configured to hold a wafer W which is an example of a substrate. The centering stage 10 is a stage for performing centering of the wafer W, and the process stage 20 is a stage for polishing the wafer W. During centering of the wafer W, the wafer W is held only by the centering stage 10. During polishing of the wafer W, the wafer W is held only by the process stage 20.

The process stage 20 has a space 22 formed therein. The centering stage 10 is housed in the space 22 of the process stage 20. The centering stage 10 has a first substrate holding surface 10*a* for holding a first area of a lower surface of the wafer W. The process stage 20 has a second substrate holding surface 20*a* for holding a second area of the lower surface of the wafer W. The first area and the second area are located at different positions in the lower surface of the wafer W. In this embodiment, the first substrate holding surface 10*a* has a circular shape, and is configured to hold a center-side area of the lower surface of the wafer W. The second substrate holding surface 20*a* has an annular shape, and is configured to hold a peripheral area of the lower surface of the wafer W. The center-side area is located inside the peripheral area. In this embodiment, the center-side area is a circular area containing the central point of the wafer W, while the center-side area may be an annular area not containing the central point of the wafer W as long as the center-side area is located inside the peripheral area. The second substrate holding surface 20*a* is arranged so as to surround the first substrate holding surface 10*a*. A width of the annular second substrate holding surface 20*a* is, for example, in a range of 5 mm to 50 mm.

The centering stage 10 is coupled to a support shaft 30 via a bearing 32. The support shaft 30 is disposed below the centering stage 10. The bearing 32 is secured to an upper end of the support shaft 30, and rotatably supports the centering stage 10. The centering stage 10 is coupled to a motor M1 through a torque transmitting mechanism 35 which may be comprised of pulleys and a belt, so that the centering stage 10 can be rotated about its central axis. The motor M1 is secured to a coupling block 31. The motor M1 and the torque transmitting mechanism 35 constitute a centering-stage rotating mechanism 36 for rotating the centering stage 10 on its central axis C1. A rotary encoder 38 is coupled to the motor M1, so that an angle of rotation of the centering stage 10 is measured by the rotary encoder 38.

The centering stage 10 and the support shaft 30, in their interiors, are provided with a first vacuum line 15 extending in the axial direction of the centering stage 10 and the support shaft 30. The first vacuum line 15 is coupled to a vacuum source (not shown) through a rotary joint 44 secured to a lower end of the support shaft 30. The first vacuum line 15 has a top opening lying in the first substrate holding surface 10*a*. Therefore, when a vacuum is created in the first vacuum line 15, the center-side area of the wafer W is held on the first substrate holding surface 10*a* by vacuum suction.

The centering stage 10 is coupled to a stage elevating mechanism 51 through the support shaft 30. The stage elevating mechanism 51 is disposed below the process stage 20 and coupled to the support shaft 30. The stage elevating mechanism 51 is capable of moving up and down the support shaft 30 and the centering stage 10 together.

The centering stage 10 is coupled to a moving mechanism 41 for moving the centering stage 10 along a predetermined horizontally-extending offset axis OS. The centering stage 10 is rotatably supported by a linear bearing 40, which is secured to the coupling block 31. The linear bearing 40 is configured to rotatably support the centering stage 10 while allowing vertical movement of the centering stage 10. A ball spline bearing, for example, can be used as the linear bearing 40.

The moving mechanism 41 includes the above-described coupling block 31, an actuator 45 for horizontally moving the centering stage 10, and a linear-motion guide 46 for restricting the horizontal movement of the centering stage 10 to horizontal movement along the above-described offset axis OS. This offset axis OS is an imaginary movement axis extending in a longitudinal direction of the linear-motion guide 46. The offset axis OS is shown by arrow in FIG. 1.

The linear-motion guide 46 is secured to a base 42. The base 42 is secured to a support arm 43, which is coupled to a stationary member, such as a frame of the polishing apparatus. The coupling block 31 is horizontally movably supported by the linear-motion guide 46. The actuator 45 includes an offset motor 47 secured to the base 42, an eccentric cam 48 mounted to a drive shaft of the offset motor 47, and a recess 49 which is formed in the coupling block 31 and in which the eccentric cam 48 is housed. When the offset motor 47 rotates the eccentric cam 48, the eccentric cam 48, while keeping in contact with the recess 49, moves the coupling block 31 horizontally along the offset axis OS.

When the actuator 45 is set in motion, the centering stage 10 is horizontally moved along the offset axis OS, with its movement direction being guided by the linear-motion guide 46. The position of the process stage 20 is fixed. The moving mechanism 41 moves the centering stage 10 horizontally relative to the process stage 20, while the stage elevating mechanism 51 moves the centering stage 10 vertically relative to the process stage 20.

The centering stage 10, the centering-stage rotating mechanism 36 and the moving mechanism 41 are housed in the space 22 of the process stage 20. This arrangement can allow a substrate holding section including the centering stage 10, the process stage 20, etc. to be compact. Further, the process stage 20 can protect the centering stage 10 from a polishing liquid (e.g. pure water or a liquid chemical) supplied to the surface of the wafer W during polishing of the wafer W.

The process stage 20 is rotatably supported by a not-shown bearing. The process stage 20 is coupled to a motor M2 through a torque transmitting mechanism 55 which may be comprised of pulleys and a belt, so that the process stage 20 can be rotated about its central axis C2. A rotary encoder 59 is coupled to the motor M2, so that an angle of rotation of the process stage 20 is measured by the rotary encoder 59. The motor M2 and the torque transmitting mechanism 55 constitute a process stage rotating mechanism 56 for rotating the process stage 20 about its central axis C2.

The process stage 20 is comprised of an increased diameter portion 20*b* having the annular second substrate holding surface 20*a*, and a decreased diameter portion 20*c* supporting the increased diameter portion 20*b*. An upper surface of the increased diameter portion 20*b* constitutes the annular second substrate holding surface 20*a*, and the second substrate holding surface 20*a* has an outer diameter slightly smaller than a diameter of the wafer W. Further, the outer diameter of the increased diameter portion 20*b* is gradually decreased from the upper surface that is the substrate holding surface 20*a* toward a lower surface, and the outer diameter of a lower surface of the increased diameter portion 20*b* is equal to an outer diameter of an upper surface of the decreased diameter portion 20*c*. In this embodiment, the increased diameter portion 20*b* is secured to the decreased diameter portion 20*c* by not-shown fixing members. However, the increased diameter portion 20*b* may be formed integrally with the decreased diameter portion 20*c*.

A plurality of second vacuum lines 25 are provided in the process stage 20. These second vacuum lines 25 are each coupled to a vacuum source (not shown) through a rotary joint 58. The second vacuum lines 25 are formed in the increased diameter portion 20*b* and the decreased diameter portion 20*c*, and have top openings, respective, lying in the second substrate holding surface 20*a*. Therefore, when a vacuum is created in each second vacuum line 25, the peripheral area of the lower surface of the wafer W is held on the second substrate holding surface 20*a* by vacuum suction. As described above, the outer diameter of the second substrate holding surface 20*a* is smaller than the diameter of the wafer W, and thus a periphery of the wafer W held on the second substrate holding surface 20*a* protrudes from the second substrate holding surface 20*a*.

A polishing head 5 for pressing a polishing tool 1 against a peripheral portion of the wafer W is disposed above the second substrate holding surface 20*a* of the process stage 20. The polishing head 5 is configured to be movable both in the vertical direction and in the radial direction of the wafer W. While keeping a lower surface (or a polishing surface) of the polishing tool 1 parallel to the upper surface of the wafer W, the polishing head 5 presses the polishing tool 1 downwardly against the peripheral portion of the rotating wafer W, thereby polishing the peripheral portion of the wafer W. A polishing tape or a whetstone can be used as the polishing tool 1.

In this embodiment, the polishing apparatus further has an eccentricity detecting mechanism 54 including an eccentricity detector 60 which is disposed on the side of the centering stage 10 and the process stage 20, and a laterally-moving mechanism 69 coupled to the eccentricity detector 60. The eccentricity detector 60 is configured to measure an amount of eccentricity and an eccentricity direction of the center of the wafer W, held on the centering stage 10, from a central axis C1 of the centering stage 10, and an amount of eccentricity and an eccentricity direction of the center of the wafer W, held on the process stage 20, from a central axis C2 of the process stage 20. The laterally-moving mechanism 69 enables the eccentricity detector 60 to be moved in directions closer to and away from the peripheral portion of the wafer W.

The eccentricity detector 60 shown in FIG. 1 is an optical eccentricity sensor, which includes a light emitting section 61 for emitting light, a light receiving section 62 for receiving the light, and a processing section 65 for determining the amount of eccentricity and the eccentricity direction of the wafer W from an amount of light measured by the light receiving section 62. In the eccentricity detector 60 shown in FIG. 1, the light receiving section 62 is disposed below the light emitting section 61, and receives the light emitted downward by the light emitting section 61. Although not shown, an arrangement of the light emitting section 61 and the light receiving section 62 may be vertically reversed. In this case, the light receiving section 62 is disposed above the light emitting section 61, and receives the light emitted upward by the light emitting section 61. The laterally-moving mechanism 69 has, for example, a rod coupled to a side surface of the eccentricity detector 60, and an actuator for advancing and retreating this rod. The actuator of the laterally-moving mechanism 69 can be activated to thereby move the eccentricity detector 60 in directions closer to and away from the peripheral portion of the wafer W via the rod.

Figure 2:
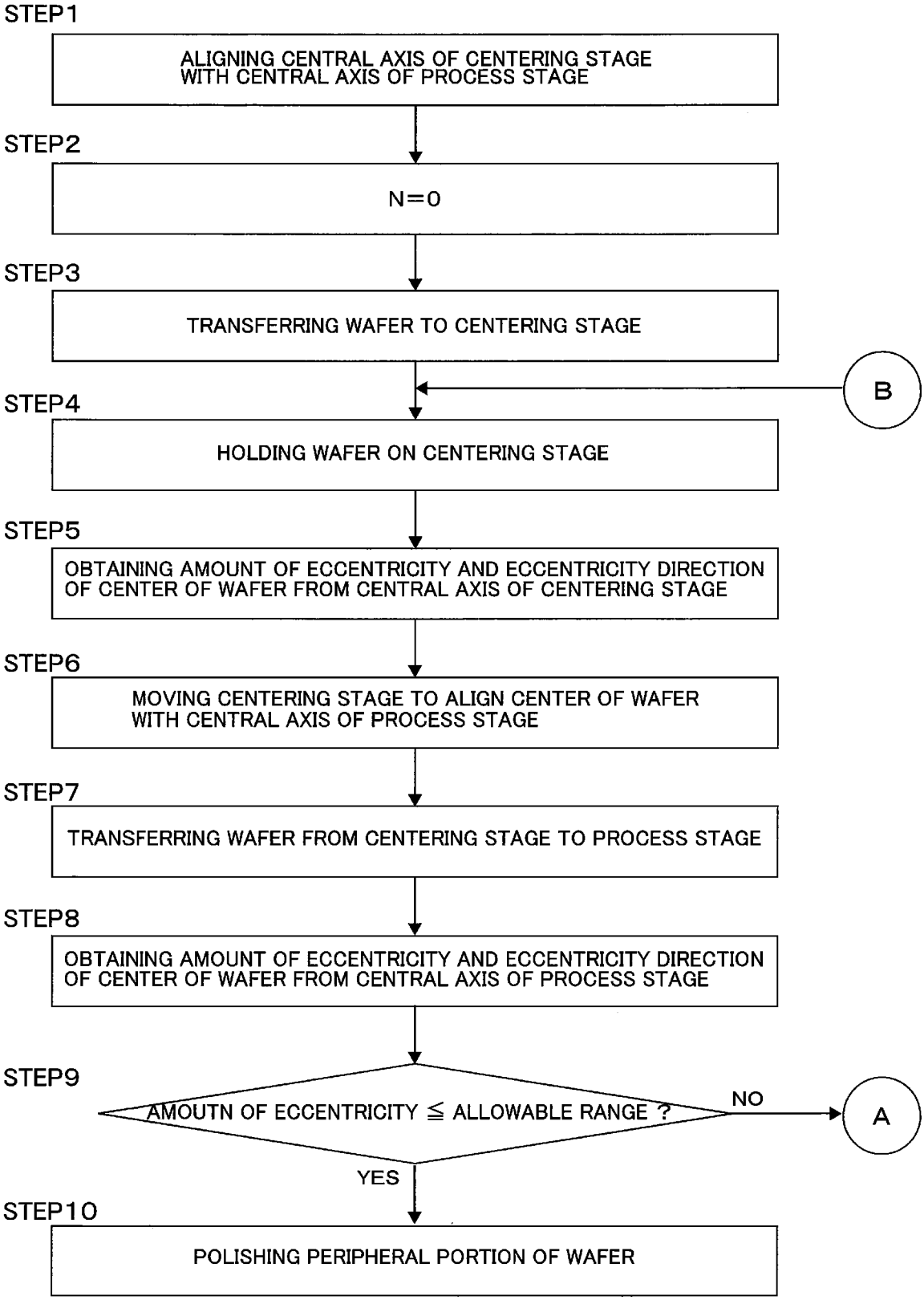
FIG. 2 is an operation flow chart illustrating a method of polishing a peripheral portion of a wafer by use of the polishing apparatus shown in FIG. 1.
Figure 3:
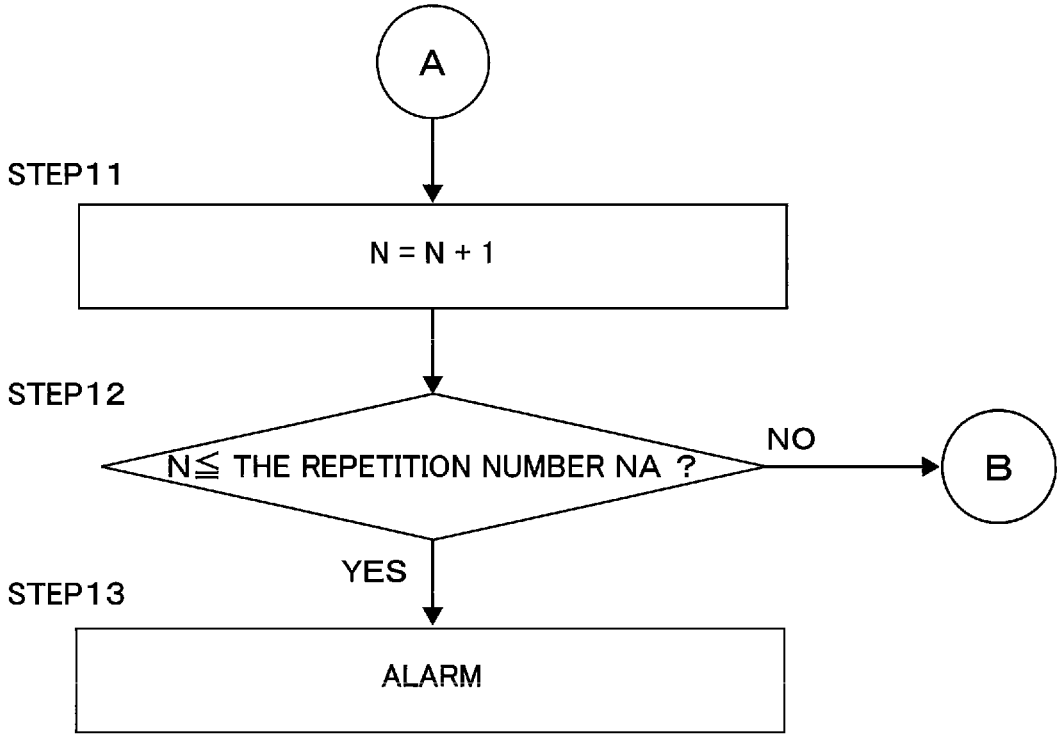
FIG. 3 is an operation flow chart performed in a case where an amount of eccentricity of a wafer held on a process stage exceeds an allowable range in the operation flow chart shown in FIG. 2.

Next, with reference to FIGS. 2 through 15, a method of polishing the peripheral portion of the wafer W with the center of the wafer W being aligned with the central axis C2 of the process stage 20 with high accuracy, will be described below. FIG. 2 is an operation flow chart illustrating a method of polishing the peripheral portion of the wafer W by use of the polishing apparatus shown in FIG. 1. FIG. 3 is an operation flow chart performed in a case where an amount of eccentricity of the wafer held on a process stage exceeds an allowable range in the operation flow chart shown in FIG. 2. As shown in FIG. 1, the polishing apparatus has an operation controller 75, and the eccentricity detector 60 is coupled to the operation controller 75. In this embodiment, the operation controller 75 is configured to control operations of each of the components of the polishing apparatus including the centering-stage rotating mechanism 36, the stage elevating mechanism 51, the moving mechanism 41, the process-stage rotating mechanism 56, and the eccentricity detecting mechanism 54.

In general, in order to align the center of the wafer W with the central axis C2 of the process stage 20 by using the centering stage 10, it is preferable that the central axis C1 of the centering stage 10 coincides with the central axis C2 of the process stage 20. Accordingly, in this embodiment, a position of the central axis C2 of the process stage 20 with respect to the central axis C1 of the centering stage 10 is manually adjusted, such that a line interconnecting the central axis C1 of the centering stage 10 and the central axis C2 of the process stage 20 is parallel with a direction (i.e., the offset axis OS) in which the moving mechanism 41 moves the centering stage 10. Next, the operation controller 75 causes the centering stage 10 to be moved by the moving mechanism 41 (see FIG. 1) until the central axis C1 of the centering stage 10 coincides with the central axis C2 of the process stage 20 (see STEP 1 in FIG. 2). Next, the operation controller 75 causes N representing the repetition number of centering operation, which will be described later, to be set to zero (see STEP 2 in FIG. 2). In this state, the wafer W to be polished is transferred on the centering stage 10 (see STEP 3 in FIG. 2).

Figure 4:
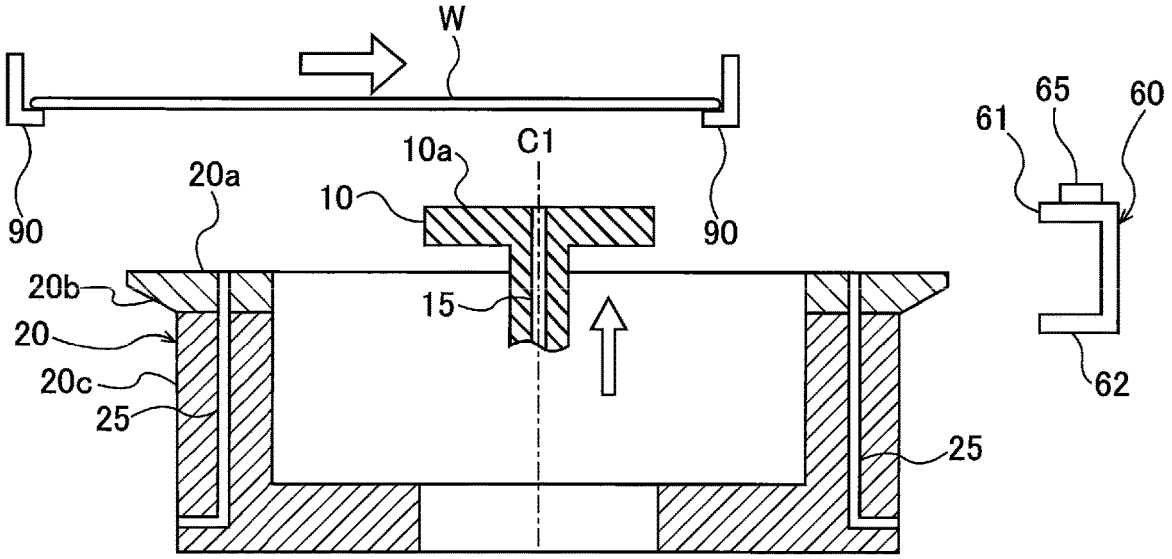
FIG. 4 is a diagram illustrating an operation of transporting a wafer, to be polished, by hands of a transport mechanism.
Figure 5:
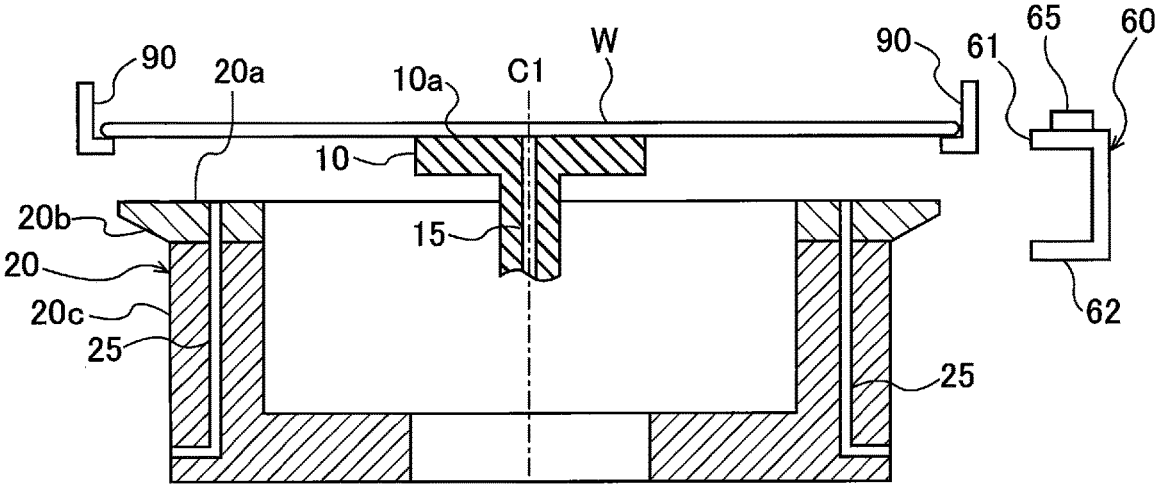
FIG. 5 is a diagram illustrating an operation of holding the wafer with the centering stage.

FIG. 4 is a diagram illustrating an operation of transporting a wafer W, to be polished, by hands 90 of a transport mechanism, and FIG. 5 is a diagram illustrating an operation of holding the wafer W with the centering stage 10. In FIGS. 4 and 5, components other than the hands 90, the centering stage 10, the process stage 20, and the eccentricity detector 60 are omitted.

As shown in FIG. 4, the centering stage 10 is elevated to an elevated position by the stage elevating mechanism 51 (see FIG. 1). The first substrate holding surface 10*a* of the centering stage 10 at this elevated position lies at a higher position than the second substrate holding surface 20*a* of the process stage 20.

In this state, a wafer W is transported by the hands 90 of a transport mechanism and placed on the circular first substrate holding surface 10*a* of the centering stage 10 as shown in FIG. 5. A vacuum is created in the first vacuum line 15, whereby the center-side area of the lower surface of the wafer W is held on the first substrate holding surface 10*a* by vacuum suction (see STEP 4 in FIG. 2).

Next, the operation controller 75 uses the eccentricity detector 60 of the eccentricity detecting mechanism 54 to obtain an amount of eccentricity and an eccentricity direction of the center of the wafer W from the central axis C1 of the centering stage 10 (see STEP 5 in FIG. 2).

Figure 6:
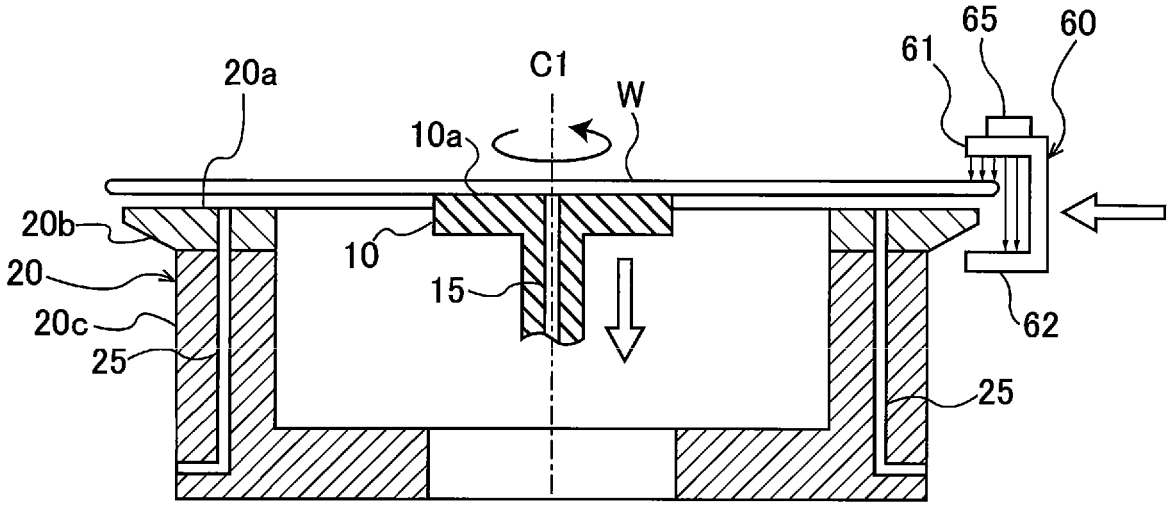
FIG. 6 is a diagram illustrating an operation of measuring the amount of eccentricity and the eccentricity direction of the center of the wafer from the central axis of the centering stage by use of an eccentricity detector.

FIG. 6 is a diagram illustrating an operation of measuring the amount of eccentricity and the eccentricity direction of the center of the wafer W from the central axis C1 of the centering stage 10 by use of the eccentricity detector 60. In FIG. 6 also, components other than the centering stage 10, the process stage 20, and the eccentricity detector 60 are omitted. After the wafer W is held on the first substrate holding surface 10*a* of the centering stage 10 as shown in FIG. 5, the hands of the transport mechanism leave the polishing apparatus. Thereafter, as shown in FIG. 6, the centering stage 10 is moved to an eccentricity detecting position by the stage elevating mechanism 51. Specifically, the centering stage 10 is lowered from the elevated position to the eccentricity detecting position. The eccentricity detecting position is a position of the centering stage 10 that is set for the eccentricity detector 60 to measure the amount of eccentricity and the eccentricity direction of the center of the wafer W, held on the centering stage 10, from the central axis C1 of the centering stage 10. The eccentricity detecting position is located at a position lower than the above-mentioned elevated position, and higher than the second substrate holding surface 20*a* of the process stage 20. Specifically, the eccentricity detecting position is arranged between the elevated position and the second substrate holding surface 20*a*. A distance between the first substrate holding surface 10*a* of the centering stage 10 located at the eccentricity detecting position and the second substrate holding surface 20*a* of the process stage 20 is, for example, within a range of 5 mm to 10 mm.

In one embodiment, in order to transport the wafer W from the hands 90 of the transport mechanism to the centering stage 10, the centering stage 10 may be elevated to the eccentricity detecting position shown in FIG. 6, instead of the elevated position shown in FIG. 4. In this case, the wafer W is transported, by the hands 90 of the transport mechanism, to the first substrate holding surface 10*a* of the centering stage 10 located at the eccentricity detecting position, and then held on the first substrate surface 10*a* by vacuum suction. Thereafter, without changing the elevating position of the centering stage 10, the amount of eccentricity and the eccentricity direction of the wafer W held on the centering stage 10 which is located at the eccentricity detecting position is measured by the eccentricity detector 60 of the eccentricity detecting mechanism 54.

In this embodiment, when the centering stage 10 is at the eccentricity detecting position, a position of the light emitting section 61 of the eccentricity detector 60 in the vertical direction is higher than an upper surface of the wafer W held on the centering stage 10, and a position of the light receiving section 62 of the eccentricity detector 60 in the vertical direction is lower than a periphery of the increased diameter portion 20*b* of the process stage 20. Specifically, the eccentricity detector 60 is configured so that a distance between a lower surface of the light emitting section 61 and an upper surface of the light receiving section 62 in the vertical direction is greater than a distance between the upper surface of the wafer W held on the centering stage 10 which is located at the eccentricity detecting position and the periphery of the increased diameter portion 20*b* of the process stage 20.

Therefore, as shown in FIG. 6, when the eccentricity detector 60 is moved closer to the wafer W held on the centering stage 10 which is located at the eccentricity detecting position, the light emitting section 61 and the light receiving section 62 of the eccentricity detector 60 are positioned so as to sandwich the peripheral portion of the wafer W and the periphery of the increased diameter portion 20*b* of the process stage 20. In this state, the amount of eccentricity and the eccentricity direction of the center of the wafer W from the central axis C1 of the centering stage 10 are measured.

More specifically, the amount of eccentricity of the wafer W held on the centering stage 10 which is located at the eccentricity detecting position, is measured in the following manner. As shown in FIG. 6, the eccentricity detector 60 is moved closer to the peripheral portion of the wafer W until the peripheral portion of the wafer W and the peripheral of the increased diameter portion 20*b* of the process stage 20 are sandwiched between the light emitting section 61 and the light receiving section 62. While the wafer W is being rotated about the central axis C1 of the centering stage 10, the light is emitted from the light emitting section 61 toward the light receiving section 62. Part of the light is blocked by the wafer W, while the remainder of the light reaches the light receiving section 62.

Figure 7:
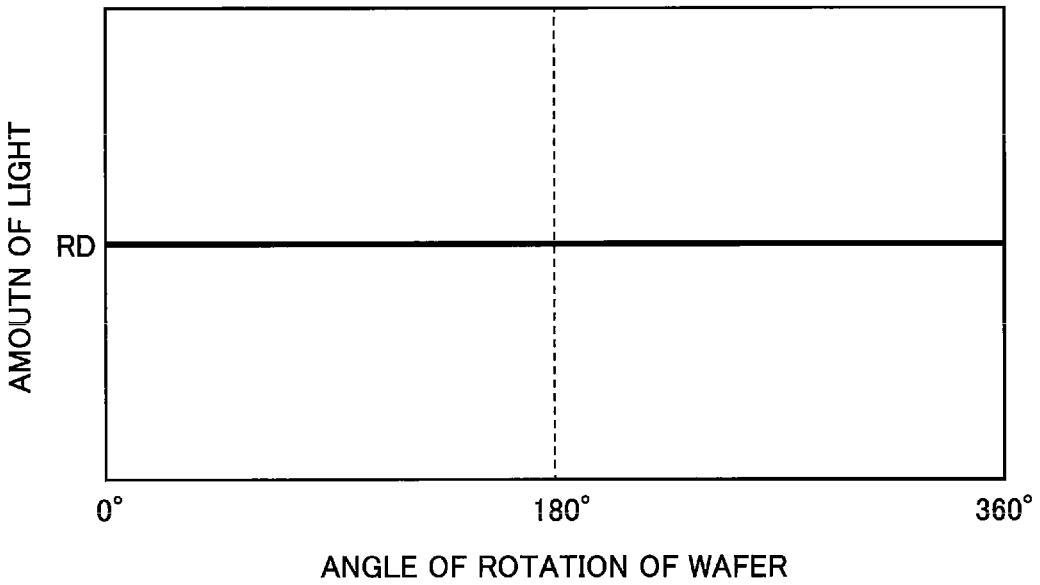
FIG. 7 is a graph showing an amount of light obtained during one revolution of a wafer held on the centering stage.
Figure 8:
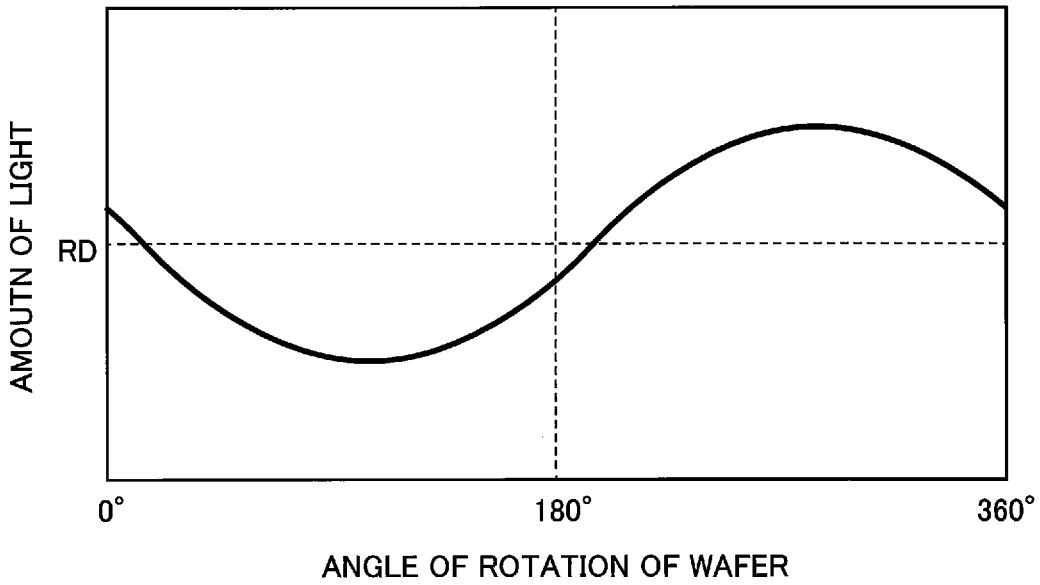
FIG. 8 is a graph showing an amount of light obtained during one revolution of a wafer held on the centering stage.

The amount of light, measured by the light receiving section 62, changes depending on the relative position between the wafer W and the centering stage 10. If the center of the wafer W is on the central axis C1 of the centering stage 10, the amount of light, obtained during one revolution of the wafer W, is maintained at a predetermined reference light amount RD as shown in FIG. 7. In contrast, if the center of the wafer W is deviated from the central axis C1 of the centering stage 10, the amount of light, obtained during one revolution of the wafer W, changes with angle of rotation of the wafer W as shown in FIG. 8.

The amount of eccentricity of the wafer W is inversely proportional to the amount of light measured by the light receiving section 62. In other words, an angle of the wafer W at which the amount of light reaches its minimum is an angle at which the amount of eccentricity of the wafer W is a maximum. The reference light amount RD represents an amount of light which has been measured on a reference wafer (or a reference substrate) having a reference diameter (e.g. 300.00 mm) with is center lying on the central axis C1 of the centering stage 10. The reference light amount RD is stored in advance in the processing section 65. Further, data (e.g. a table or a relational expression) on a relationship between the amount of light and the amount of eccentricity of the wafer W from the central axis C1 of the centering stage 10 is stored in advance in the processing section 65. The amount of eccentricity corresponding to the reference light amount RD is 0. Based on the data, the processing section 65 determines the amount of eccentricity of the wafer W from a measured amount of light.

The processing section 65 of the eccentricity detector 60 is coupled to the rotary encoder 38 (see FIG. 1). A signal indicating the angle of rotation of the centering stage 10 (i.e. the angle of rotation of the wafer W) is sent from the rotary encoder 38 to the processing section 65. The processing section 65 determines a maximum eccentric angle of the wafer W at which the amount of light reaches its minimum. This maximum eccentric angle indicates the eccentricity direction of the center of the wafer W from the central axis C1 of the centering stage 10. A maximum eccentric point on the wafer W, which is farthest from the axis C1 of the centering stage 10, is identified by the maximum eccentric angle. Further, the processing section 65 calculates the amount of eccentricity based on a difference between the reference light amount RD and an amount of light on the maximum eccentric point (or an amount of light on a minimum eccentric point). In this manner, the processing section 65 of the eccentricity detector 60 obtains the amount of eccentricity and the eccentricity direction of the center of the wafer W from the central axis C1 of the centering stage 10. Further, the processing section 65 sends the amount of eccentricity and the eccentricity direction that have been determined, to the operation controller 75 (see FIG. 1), and the operation controller 75 stores the amount of eccentricity and the eccentricity direction that have been received.

Figure 9:
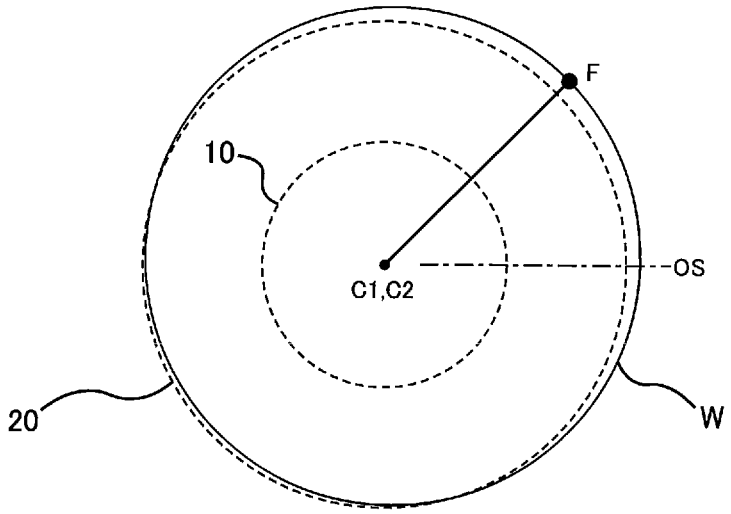
FIG. 9 is a diagram showing an operation for correcting an eccentricity of the wafer.
Figure 10:
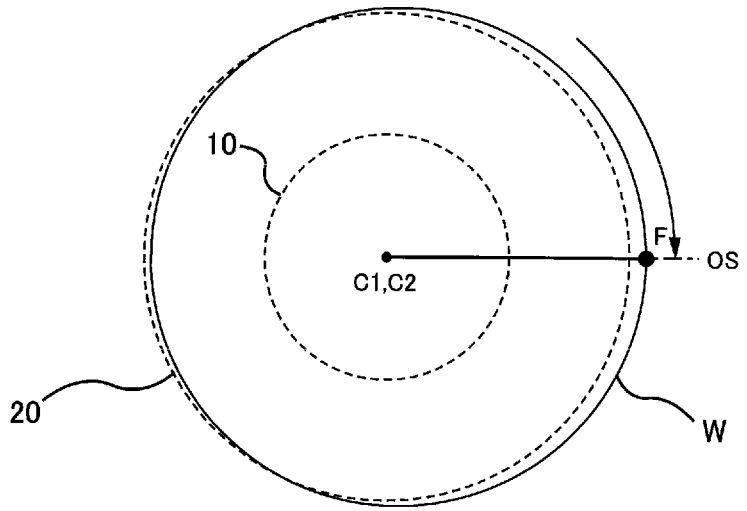
FIG. 10 is a diagram showing an operation for correcting the eccentricity of the wafer.
Figure 11:
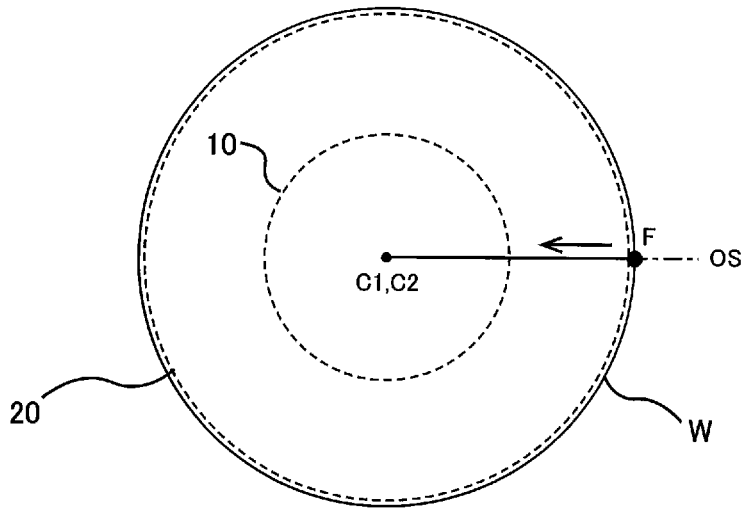
FIG. 11 is a diagram showing an operation for correcting the eccentricity of the wafer.

Next, the operation controller 75 causes the center of the wafer W to be aligned with the central axis C2 of the process stage 20 by use of the centering-stage rotating mechanism 36 and the moving mechanism 41 (see STEP 6 in FIG. 2). FIGS. 9 through 11 are plan views of the wafer W on the centering stage 10. In the example shown in FIG. 9, the center of the wafer W, placed on the centering stage 10, is out of alignment with the central axis C1 of the centering stage 10 (and the central axis C2 of the process stage 20). A maximum eccentric point (imagination point) F on the wafer W (i.e., the eccentricity direction of the wafer W) that is farthest from the central axis C1 of the centering stage 10 (and the central axis C2 of the process stage 20) is not on the offset axis (imagination axis) OS of the moving mechanism 41 as viewed from above the wafer W. Thus, as shown in FIG. 10, the centering stage 10 is rotated until the maximum eccentric point F is located on the offset axis OS as viewed from above the wafer W. Specifically, the centering stage 10 is rotated until a line interconnecting the maximum eccentric point F and the central axis C1 of the centering stage 10 (i.e., the eccentricity direction of the wafer W) becomes parallel to the offset axis OS. The rotation angle (i.e., a rotation amount) of the centering stage 10 at this time corresponds to a difference between an angle that identifies the position of the maximum eccentric point F and an angle that identifies the position of the offset axis OS.

Further, as shown in FIG. 11, while the maximum eccentric point F is on the offset axis OS, the centering stage 10 is moved by the moving mechanism 41 (see FIG. 1) along the offset axis OS until the center of the wafer W held on the centering stage 10 is located on the central axis C2 of the process stage 20. A movement distance (i.e., a movement amount) of the centering stage 10 at this time corresponds to the amount of eccentricity of the wafer W. In this manner, the center of the wafer W is aligned with the central axis C2 of the process stage 20. In this embodiment, the centering-stage rotating mechanism 36, the moving mechanism 41 and the operation controller 75 constitute an aligner for performing the centering operation of aligning the center of the wafer W with the central axis C2 of the process stage 20 based on the amount of eccentricity and the eccentricity direction of the center of the wafer W from the central axis C1 of the centering stage 10 which are obtained by the eccentricity detecting mechanism 54.

Figure 12:
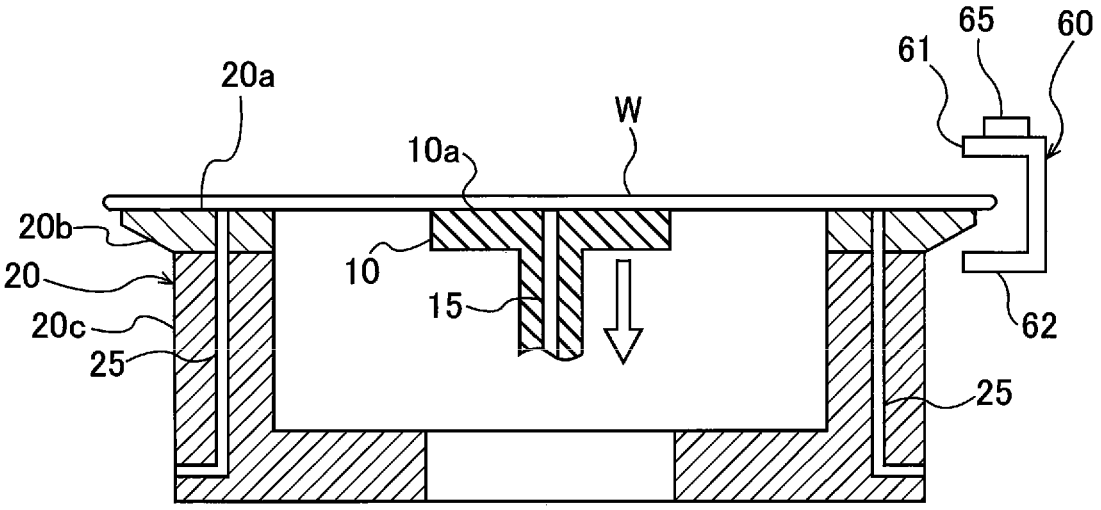
FIG. 12 is a diagram illustrating an operation of detaching the wafer from the centering stage.

Next, the wafer W held on the centering stage 10 is transferred to the process stage 20 (see STEP 7 in FIG. 2). FIG. 12 is a diagram illustrating an operation of detaching the wafer W from the centering stage 10. In FIG. 12, components other than the centering stage 10, the process stage 20, and the eccentricity detector 60 are omitted.

As shown in FIG. 12, the centering stage 10 is lowered until the peripheral area of the lower surface of the wafer W is brought into contact with the second substrate holding surface 20*a* of the process stage 20. In this state, a vacuum is created in each of the second vacuum lines 25, whereby the peripheral area of the lower surface of the wafer W is held on the process stage 20 by vacuum suction. Thereafter, the first vacuum line 15 is ventilated. As shown in FIG. 12, the centering stage 10 is further lowered to a predetermined lowered position at which the first substrate holding surface 10*a* is separated away from the wafer W. Consequently, the wafer W is held only by the process stage 20.

The centering stage 10 is configured to hold only the center-side area of the lower surface of the wafer W, while the process stage 20 is configured to hold only the peripheral area of the lower surface of the wafer W. If the wafer W is simultaneously held by both the centering stage 10 and the process stage 20, then the wafer W may warp. This is because it is very difficult in the light of mechanical positioning accuracy to make the first substrate holding surface 10*a* of the centering stage 10 and the second substrate holding surface 20*a* of the process stage 20 lie in the same horizontal plane. According to this embodiment, during polishing of the wafer W, only the peripheral area of the lower surface of the wafer W is held by the process stage 20, and the centering stage 10 is away from the wafer W. Warping of the wafer W can therefore be prevented.

As shown in FIG. 12, the wafer W is transferred from the centering stage 10 to the process stage 20, but the wafer W may, during this transferring, becomes displaced with respect to the process stage 20. Further, when the light emitting section 61 and/or the light receiving section 62 of the eccentricity detector 60 are damaged and/or failed, or when there is an error in the algorithm (for example, a bug in a program), stored in the processing section 65, for determining the amount of eccentricity and the maximum eccentric point, accurate amount of eccentricity and eccentricity direction (i.e., maximum eccentric point) cannot be obtained. Further, when the centering-stage rotating mechanism 36 and/or the moving mechanism 41 are damaged and/or failed, the centering stage 10 cannot be accurately moved based on the amount of eccentricity and the eccentricity direction obtained by the eccentricity detector 60. In these cases, the wafer W is transferred from the centering stage 10 to the process stage 20 in a condition where the center of the wafer W is not aligned with the central axis C2 of the process stage 20.

Therefore, in this embodiment, the above-described eccentricity detecting mechanism 54 is used to obtain an amount of eccentricity and an eccentricity direction of the center of the wafer W, held on the process stage 20, from the central axis of the process stage 20 (see STEP 8 in FIG. 2), and determine whether or not the amount of eccentricity obtained is within a predetermined allowable range (see STEP 9 in FIG. 2).

Figure 13:
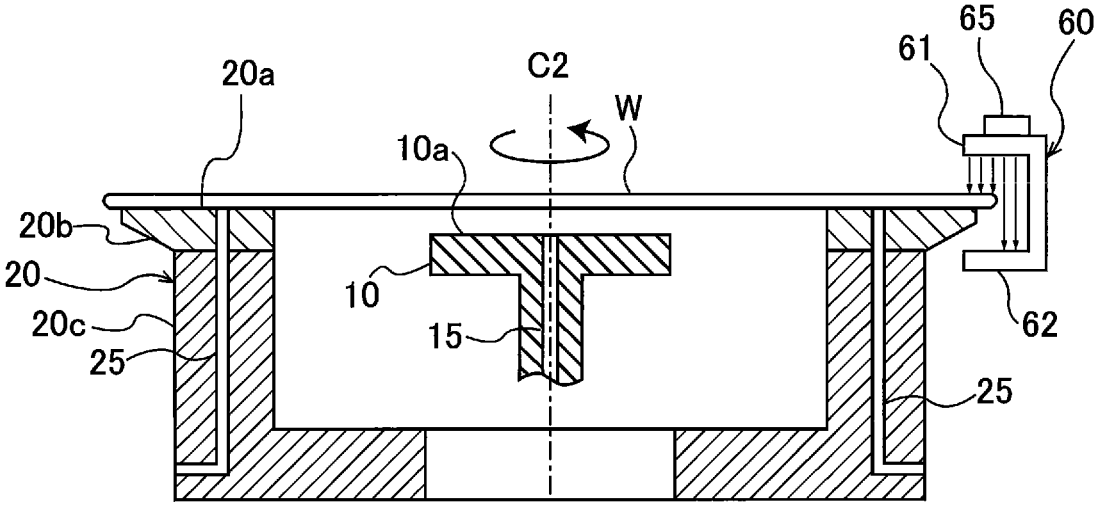
FIG. 13 is a diagram illustrating an operation of measuring the amount of eccentricity and the eccentricity direction of the center of the wafer from the central axis of the process stage.

FIG. 13 is a diagram illustrating an operation of measuring an amount of eccentricity and an eccentricity direction of the center of the wafer W from the central axis C2 of the process stage 20. As described above, the eccentricity detector 60 of the eccentricity detecting mechanism 54 is configured so that the distance between the lower surface of the light emitting section 61 and the upper surface of the light receiving section 62 in the vertical direction is greater than the distance between the upper surface of the wafer W held on the centering stage 10 which is located at the eccentricity detecting position and the lower surface of the periphery of the increased diameter portion 20*b* of the process stage 20. Accordingly, it is unnecessary to move the eccentricity detector 60 in order to measure the amount of eccentricity and the eccentricity direction of the center of the wafer W, held on the process stage 20, from the central axis C2 of the process stage 20. Specifically, the eccentricity detector 60 can measure, at the same position as the position (see FIG. 6) where the amount of eccentricity and the eccentricity direction of the center of the wafer W from the central axis C1 of the centering stage 10 have been measured, the amount of eccentricity and the eccentricity direction of the center of the wafer W, held on the process stage 20, from the central axis C2 of the process stage 20. Therefore, even though the amount of eccentricity and the eccentricity direction of the center of the wafer W, held on the process stage 20, from the axis C2 of the process stage 20 are measured, a decrease in a throughput of the polishing apparatus can be minimized.

Measuring of the amount of eccentricity and the eccentricity direction of the center of the wafer W from the central axis C2 of the process stage 20 is performed in the same manner as measuring of the amount of eccentricity and the eccentricity direction of the center of the wafer W from the central axis C1 of the centering stage 10. Specifically, while the wafer W is being rotated about the central axis C2 of the process stage 20, the light is emitted from the light emitting section 61 toward the light receiving section 62. Part of the light is blocked by the wafer W, while the remainder of the light reaches the light receiving section 62. The processing section 65 of the eccentricity detector 60 stores in advance data (e.g. a table or a relational expression) on a relationship between the amount of light measured by the light receiving section 62 and the amount of eccentricity of the wafer W from the central axis C2 of the process stage 20. Based on the data, the processing section 65 determines the amount of eccentricity of the wafer W from a measured amount of light. Further, the processing section 65 determines an eccentric direction (i.e., a maximum eccentric point) on the wafer W which is farthest from the axis C2 of the process stage 20, based on a maximum eccentric angle of the wafer W at which the amount of light reaches its minimum. The processing section 65 sends the amount of eccentricity and the eccentricity direction that have been determined, to the operation controller 75 (see FIG. 1), and the operation controller 75 stores the amount of eccentricity and the eccentricity direction that have been received.

Figure 14:
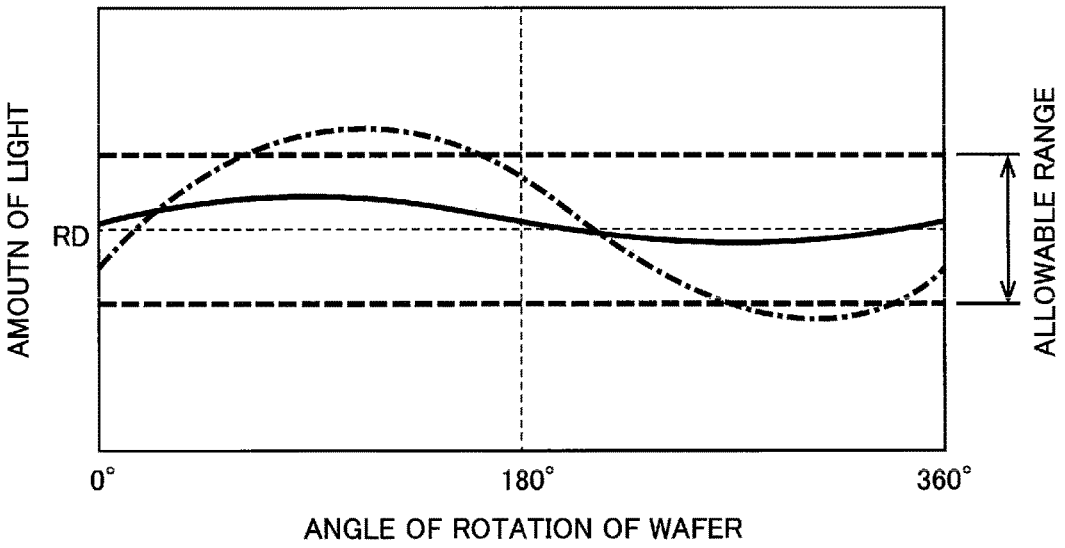
FIG. 14 is a graph showing an example of an amount of light obtained during one revolution of a wafer held on the process stage.

FIG. 14 is a graph showing an example of an amount of light obtained during one revolution of a wafer W held on the process stage 20. FIG. 14 illustrates a predetermined allowable range stored in advance in the operation controller 75. This allowable range is an allowable range in the amount of light, calculated based on an acceptable value of the deviation in the polishing width of the peripheral portion of the wafer W, and is determined in advance. In FIG. 14, the light amount within the predetermined allowable range is illustrated by a thick solid line, the light amount out of the predetermined allowable range is illustrated by dot-and-dash line, and the upper and lower light amounts defining the allowable range are illustrated by thick dotted lines.

When, as with the light amount represented by the solid line in FIG. 14, the amount of eccentricity of the center of the wafer W from the central axis C2 of the process stage 20 is within the allowable range (see YES of STEP 9 in FIG. 2), the operation controller 75 performs a polishing of the peripheral portion of the wafer W (see STEP 10 in FIG. 2).

Figure 15:
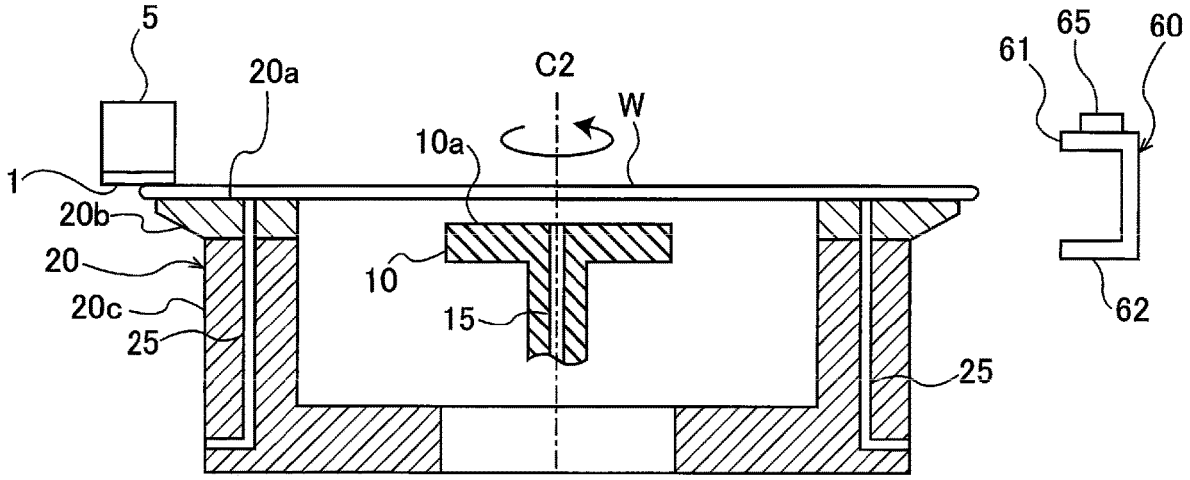
FIG. 15 is a diagram illustrating an operation of polishing a peripheral portion of the wafer, while rotating the wafer by use of the process stage.

FIG. 15 is a diagram illustrating an operation of polishing the peripheral portion of the wafer W, while rotating the wafer W by use of the process stage 20. As shown in FIG.

15, the process stage 20 is rotated about its central axis C2. Since the center of the wafer W is on the central axis C2 of the process stage 20, the wafer W is rotated about the center of the wafer W. In this state, a polishing liquid (e.g. pure water or slurry) is supplied onto the wafer W from a not-shown polishing-liquid supply nozzle. Further, the polishing head 5 presses down the polishing tool 1, with its lower surface (polishing surface) being parallel to the upper surface of the wafer W, against the peripheral portion of the rotating wafer W, thereby polishing the peripheral portion of the wafer W. Since the peripheral area of the lower surface of the wafer W is held on the process stage 20 during polishing of the wafer W, the process stage 20 can support the load of the polishing tool 1 from below the polishing tool 1. This can prevent warping of the wafer W during polishing.

In this manner, in this embodiment, it is confirmed whether or not the center of the wafer W is aligned with the central axis C2 of the process stage 20 after the wafer W is transferred from the centering stage 10 to the process stage 20. More specifically, after the wafer W is transferred from the centering stage 10 to the process stage 20, the amount of the eccentricity and the eccentricity direction of the center of the wafer W from the central axis C2 of the process stage 20 are obtained (see STEP 8 in FIG. 2), and it is confirmed whether or not this amount of eccentricity is within the allowable range (see STEP 9 in FIG. 2). Polishing of the peripheral portion of the wafer W is performed after confirming that the center of the wafer W is aligned with the central axis C2 of the process stage 20 with high accuracy. As a result, a defective wafer W polished beyond the allowable polishing width can be prevented from being produced.

On the other hand, when, as with the light amount illustrated by the dot-and-dash line in FIG. 14, the amount of eccentricity of the center of the wafer W from the central axis C2 of the process stage 20 is out of the allowable range (see NO of STEP 9 in FIG. 2), the operation controller 75 adds 1 to N representing the repetition number of centering operation (see STEP 11 in FIG. 3). The centering operation is the operation represented by the above-described STEP 6, and the initial value of N is 0. Next, the operation controller 75 compares N obtained in STEP 11 with a predetermined repetition number NA (see STEP 12 in FIG. 3).

The predetermined repetition number NA is a natural number stored in advance in the operation controller 75, and the user of the polishing apparatus can arbitrarily set the predetermined repetition number NA. The predetermined repetition number NA may be 1. When N obtained in STEP 11 reaches the predetermined repetition number NA (see YES of STEP 12 in FIG. 3), the operation controller 75 causes the operation of the polishing apparatus to be stopped, and an alarm to be generated (see STEP 13 in FIG. 3). This prevents the peripheral portion of the wafer W from being polished with an inaccurate polishing width. Further, an operator who has received the alarms can check each component of the polishing apparatus to thereby find parts having a problem, such as a failure and/or damage, at an early stage. In a case where the predetermined repetition number NA is set to 1, the operation controller 75 immediately causes the operation of the polishing apparatus to be stopped without repeating the centering operation, and the alarm to be generated.

When N obtained in STEP 11 does not reach the repetition number NA (see NO of STEP 12 in FIG. 3), the operation controller 75 performs the above-described centering operation again. Specifically, the operation controller 75 causes the centering stage 10 to be elevated until the first substrate holding surface 10*a* of the centering stage 10 is brought into contact with the lower surface of the wafer W, and causes the centering stage 10 to hold the wafer W held on the process stage 20 (see STEP 4 in FIG. 2). Next, the operation controller 75 cause the amount of eccentricity and the eccentricity direction of the center of the wafer W from the central axis C1 of the centering stage 10 to be obtained by use of the eccentricity detector 60 of the eccentricity detecting mechanism 54 (see STEP 5 in FIG. 2), and performs the centering operation, in which the center of the wafer W is aligned with the central axis C2 of the process stage 20 by use of the centering-stage rotating mechanism 36 and the moving mechanism 41 (see STEP 6 in FIG. 2). Further, the operation controller 75 causes the wafer W held on the centering stage 10 to be transferred to the process stage 20 (see STEP 7 in FIG. 2), and obtains the amount of eccentricity and the eccentricity direction of the center of the wafer W from the central axis C2 of the process stage 20 again (see STEP 8 in FIG. 2). Next, the operation controller 75 confirms whether or not the amount of eccentricity of the center of the wafer W from the central axis C2 of the process stage 20 is within the allowable range (see STEP 9 in FIG. 2). If the amount of eccentricity of the center of the wafer W is within the predetermined allowable range, the operation controller 75 performs polishing of the peripheral portion of the wafer W (see STEP 10 in FIG. 2).

In one embodiment, in a case where the centering operation is performed again, STEP 5 in FIG. 2 may be omitted. In this case, before the wafer W is transferred from the process stage 20 to the centering stage 10, the operation controller 75 causes the centering stage 10 to be rotated based on the eccentricity direction of the wafer W with respect to the central axis C2 of the process stage 20 (i.e., the maximum eccentric point on the wafer W, which is farthest from the axis C2 of the process stage 20), which has been obtained after performing the previous centering operation. Thereafter, the operation controller 75 causes the wafer W to be transferred from the process stage 20 to the centering stage 10, and to be held on the centering stage 10 (see STEP 4 in FIG. 2). Further, the operation controller 75 causes the centering stage 10 to move in the horizontal direction based on the amount of eccentricity of the center of the wafer W from the central axis C2 of the process stage 20, without obtaining the amount of eccentricity and the eccentricity direction of the center of the wafer W from the central axis C1 of the centering stage 10 (i.e., without performing STEP 5 in FIG. 2). Even though a plurality of centering operations is performed, omitting of STEP 5 enables the decrease in the throughput of the polishing apparatus to be minimized.

In this manner, in this embodiment, the centering operations are repeated until the amount of eccentricity of the center of the wafer W from the central axis C2 of the process stage 20 is within the predetermined allowable range, or the number of centering operations reaches the predetermined repetition number NA.

In one embodiment, the operation controller 75, at first, may cause the wafer W to be transported to the process stage 20 by use of the hands 90 of the transport mechanism. That is, the hands 90 of the transport mechanism transport the wafer W to the process stage 20 instead of the centering stage 10. Further, after the hands 90 of the transport mechanism transport the wafer W to the centering stage 10 located at the elevated positon, the stage elevating mechanism 51 may cause the centering stage 10 to be lowered to thereby transfer the wafer W from the centering stage 10 to the process stage 20. In this case, the operation controller 75 obtains the amount of eccentricity and the eccentricity direction (i.e., the maximum eccentric point) of the center of the wafer W from the central axis C2 of the process stage 20 by use of the eccentricity detector 60 of the eccentricity detecting mechanism 54.

Next, the operation controller 75 causes the process stage 20 to be rotated until the maximum eccentric point of the wafer W held on the process stage 20 is located on the offset axis OS of the moving mechanism 41 as viewed from above the wafer W. Specifically, the process stage 20 is rotated until a line interconnecting the maximum eccentric point of the wafer W held on the process stage 20 and the central axis C2 of the process stage 20 (i.e., the eccentricity direction of the wafer W) becomes parallel to the offset axis OS. The rotation angle of the process stage 20 at this time corresponds to a difference between an angle that identifies the position of the maximum eccentric point of the wafer W held on the process stage 20 and an angle that identifies the position of the offset axis OS.

Next, the centering stage 10 is elevated by use of the stage elevating mechanism 51 to transfer the wafer W from the process stage 20 to the centering stage 10. Further, the operation controller 75 causes the centering stage 10 to be moved based on the amount of eccentricity obtained, of the center of the wafer W from the central axis C2 of the process stage 20. Thus, the center of the wafer W is aligned with the central axis C2 of the process stage 20. Next, the operation controller 75 causes the centering stage 10 to be lowered by use of the stage elevating mechanism 51 to transfer the wafer W from the centering stage 10 to the process stage 20, and confirms whether or not the amount of eccentricity of the wafer W held on the process stage 20 is within the predetermined allowable range. When the amount of eccentricity obtained is within the predetermined allowable range, the operation controller 75 performs polishing of the peripheral portion of the wafer W. When the amount of eccentricity obtained is out of the predetermined allowable range, the operation controller 75 repeats the centering operations until the amount of eccentricity of the center of the wafer W from the central axis C2 of the process stage 20 is within the predetermined allowable range, or the number of centering operations reaches the predetermined repetition number NA.

In this method also, after the wafer W is transferred from the centering stage 10 to the process stage 20, it is confirmed whether or not the amount of eccentricity of the center of the wafer W from the central axis C2 of the process stage 20 is within the predetermined allowable range. Therefore, the center of the wafer W can be aligned with the central axis C2 of the process stage 20 with high accuracy, so that the peripheral portion of the wafer W can be polished with the accurate polishing width. Further, according to this method, the centering-stage rotating mechanism 36 can be omitted.

Figure 16:
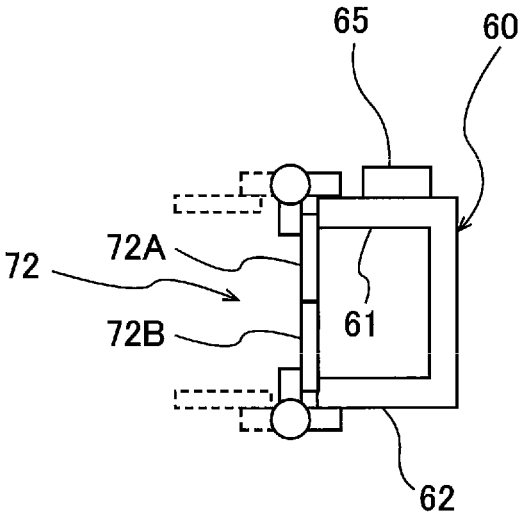
FIG. 16 is a lateral view showing schematically a modification of the eccentricity detector shown in FIG. 1.

FIG. 16 is a lateral view showing schematically a modification of the eccentricity detector 60 shown in FIG. 1. The eccentricity detector 60 shown in FIG. 16 includes a shutter 72 for isolating an interior space of the eccentricity detector 60 in which the light emitting section 61 and the light receiving section 62 are arranged. In the illustrated example, the shutter 72 is constituted of two doors 72A, 72B, which are attached to an upper surface and a lower surface of the eccentricity detector 60 via hinges, respectively. When the eccentricity detector 60 is moved toward the wafer W, the doors 72A, 72B are opened by a not-shown actuator (see a dotted line in FIG. 16). When the eccentricity detector 60 is moved away from the wafer W, the doors 72A, 72B are closed by the actuator. The shutter 72 can prevent the polishing liquid, used and scattered in polishing of the wafer W, from adhering to the light emitting section 61 and the light receiving section 62.

Figure 17:
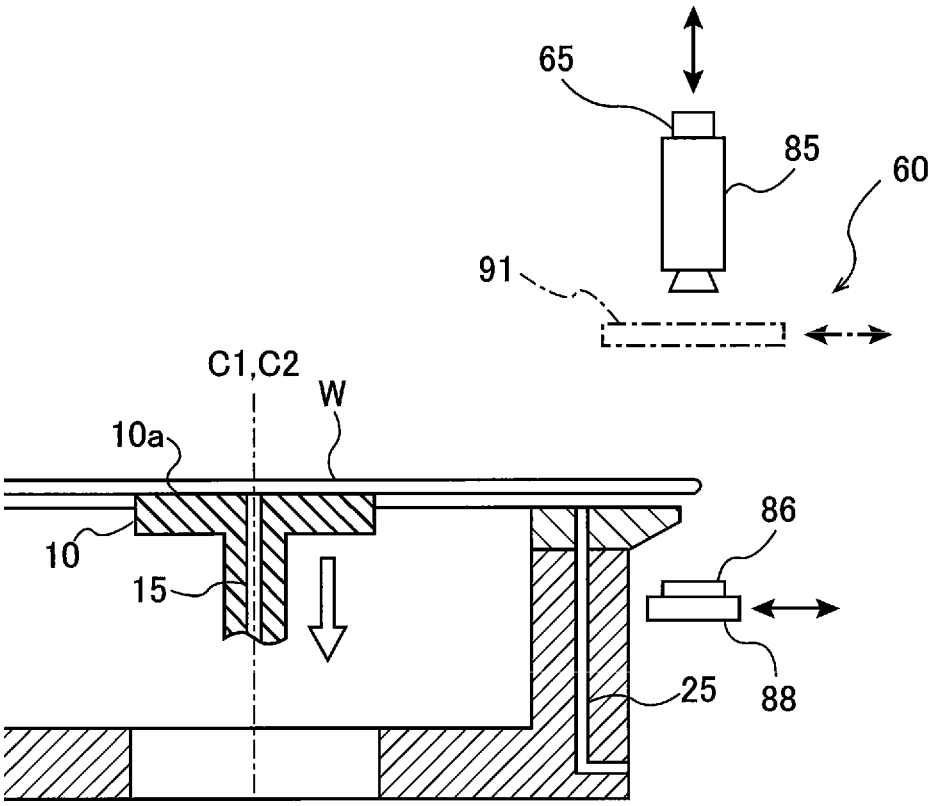
FIG. 17 is a lateral view showing schematically another modification of the eccentricity detector shown in FIG. 1.

FIG. 17 is a lateral view showing schematically another modification of the eccentricity detector shown in FIG. 1. The eccentricity detector 60 shown in FIG. 17 includes an imaging device 85, and a light projector 86 for emitting light toward the imaging device 85. The light projector 86 is disposed below the imaging device 85. The imaging device 85 is, for example, a camera (e.g., CCD camera) capable of acquiring serial still images, and the light projector 86 is, for example, a LED light secured to an upper surface of a support pedestal 88. The imaging device 85 has a lens device (not shown) that can focus on both of the peripheral portion of the wafer W held on the centering stage 10 which is located at the eccentricity detecting position, and the peripheral portion of the wafer W held on the process stage 20.

The imaging device 85 acquires serial still images of the peripheral portion of the wafer W during one revolution of the wafer W, and the processing section 65 determines the amount of eccentricity and the eccentricity direction (i.e., the maximum eccentric point) of the wafer W from the serial still images acquired. More specifically, the processing section 65 determines the amount of eccentricity of the center of the wafer W from the central axis C1 of the centering stage 10 (or the central axis C2 of the process stage 20) from positions of the peripheral portion of the wafer W in each still image acquired by the imaging device 85. Further, the processing section 65 determines the eccentricity direction (the maximum eccentric point) from signals sent from the rotary encoder 38 (or the rotary encoder 59).

The imaging device 85 is coupled to a not-shown actuator, and this actuator enables the imaging device 85 to be moved toward and away from the wafer W. The actuator coupled to the imaging device 85 is, for example, an actuator capable of moving the imaging device 85 in the vertical direction. Further, the support pedestal 88 is also coupled to a not-shown actuator, and this actuator enables the light projector 86 integrally with the support pedestal 88 to be moved toward and away from the wafer W. The actuator coupled to the support pedestal 88 is, for example, an actuator capable of moving the support pedestal 88 and the light projector 86 in the horizontal direction. Using these actuators to move the imaging device 85 and the light projector 86 away from the wafer W, the polishing liquid, used and scattered in polishing of the wafer W, is prevented from adhering to the imaging device 85 and the light projector 86.

In one embodiment, as illustrated by the imaginary lines (dot-and-dash lines) in FIG. 17, the eccentricity detecting mechanism 54 may be provided with a shutter 91 between the imaging device 85 and the wafer, the shutter 91 preventing the scattered polishing liquid from reaching the imaging device 85. This shutter 91 is also coupled to a not-shown actuator. This actuator is operated to move the shutter 91 between a blocking position where it is located between the imaging device 85 and the wafer W, and an imaging position where it is retreated from between the imaging device 85 and the wafer W. When the shutter 91 is located at the imaging position, the imaging device 85 can acquire the image of the peripheral portion of the wafer W.

Figure 18:
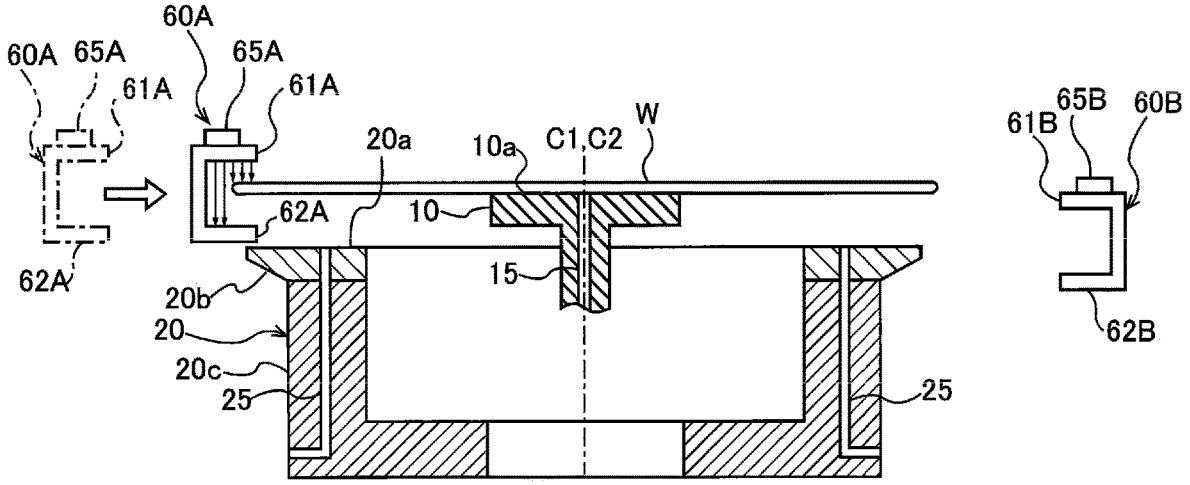
FIG. 18 is a diagram illustrating an operation of measuring the amount of eccentricity and the eccentricity direction of the center of the wafer from the central axis of the centering stage by use of an eccentricity detecting mechanism according to another embodiment.
Figure 19:
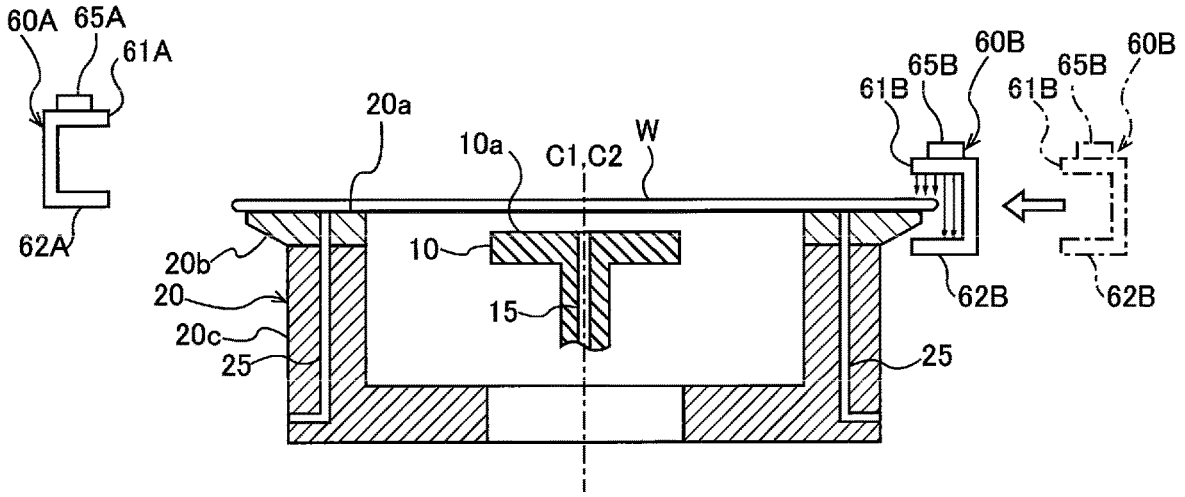
FIG. 19 is a diagram illustrating an operation of measuring the amount of eccentricity and the eccentricity direction of the center of the wafer from the central axis of the process stage by use of the eccentricity detecting mechanism according to another embodiment.

FIG. 18 is a diagram illustrating an operation of measuring the amount of eccentricity and the eccentricity direction of the center of the wafer W from the central axis C1 of the centering stage 10 by use of an eccentricity detecting mechanism 54 according to another embodiment. FIG. 19 is a diagram illustrating an operation of measuring the amount of eccentricity and the eccentricity direction of the center of the wafer W from the central axis C2 of the process stage 20 by use of the eccentricity detecting mechanism 54 according to another embodiment. Structures that are not described particularly in this embodiment are identical to those of the embodiments shown in FIG. 1, and their repetitive descriptions are omitted.

The eccentricity detecting mechanism 54 shown in FIGS. 18 and 19 includes two eccentricity detectors 60A, 60B. The eccentricity detectors 60A, 60B have the same configuration as those of the eccentricity detector 60 shown in FIG. 1, respectively. One eccentricity detector 60A is used for measuring the amount of eccentricity and the eccentricity direction of the center of the wafer W from the central axis C1 of the centering stage 10, and the other eccentricity detector 60B is used for measuring the amount of eccentricity and the eccentricity direction of the center of the wafer W from the central axis C2 of the process stage 20. Specifically, one eccentricity detector 60A is used for obtaining the amount of eccentricity and the eccentricity direction of the wafer W located at the above-described eccentricity detecting position, and the other eccentricity detector 60B is used for confirming whether or not the amount of eccentricity of the wafer W from the central axis C2 of the process stage 20 is within the allowable range. Each of the eccentricity detectors 60A, 60B may have the shutter 72 described with reference to FIG. 16. Further, each of the eccentricity detectors 60A, 60B may be constructed as the eccentricity detector shown in FIG. 17, which has the imaging device 85 and the light projector 86.

In the above-described embodiments, the centering stage 10 is moved based on the amount of eccentricity and the eccentricity direction of the center of the wafer W from the central axis C1 of the centering stage 10 to thereby align the center of the wafer W with the central axis C2 of the process stage 20. Therefore, in STEP 1 shown in FIG. 2, it is preferable that the central axis C1 of the centering stage 10 completely coincides with the central axis C2 of the process stage 20. However, due to accuracy of assembly of parts of the polishing apparatus, mechanical dimensional error, etc., it is very difficult to make the central axis C1 of the centering stage 10 completely coincide with the central axis C2 of the process stage 20.

Accordingly, embodiments will be described below with reference to FIGS. 20 through 31, in which the centering operation for aligning the center of the wafer W with the central axis C2 of the process stage 20 is performed under a condition that the central axis C1 of the centering stage 10 does not coincide with the central axis C2 of the process stage 20.

Figure 20:
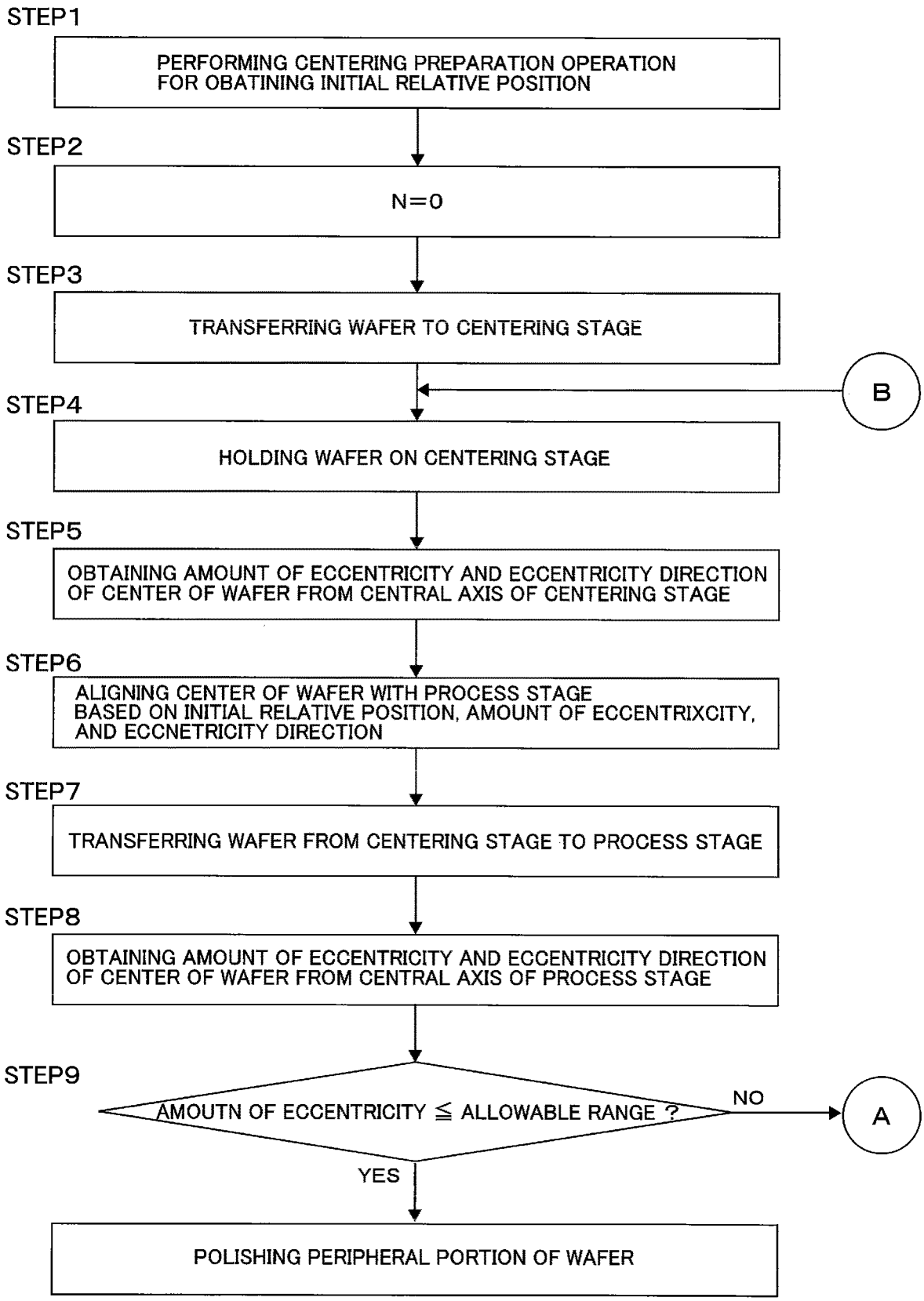
FIG. 20 is an operation flow chart illustrating another method of polishing the peripheral portion of the wafer.

FIG. 20 is an operation flow chart illustrating another method of polishing the peripheral portion of the wafer W. Steps that are not described particularly in the operation flow chart shown in FIG. 20 are identical to those of the operation flow chart shown in FIG. 2, and their repetitive descriptions are omitted. In the operation flow chart shown in FIG. 20, a centering preparation operation for obtaining an initial relative position of the central axis C1 of the centering stage 10 with respect to the central axis C2 of the process stage 20 is at first performed (see STEP 1 in FIG. 20). The centering preparation operation is performed under a condition where the central axis C1 of the centering stage 10 does not coincide with the central axis C2 of the process stage 20. This centering preparation operation is, for example, performed after performing maintenance of the polishing apparatus.

Figure 21:
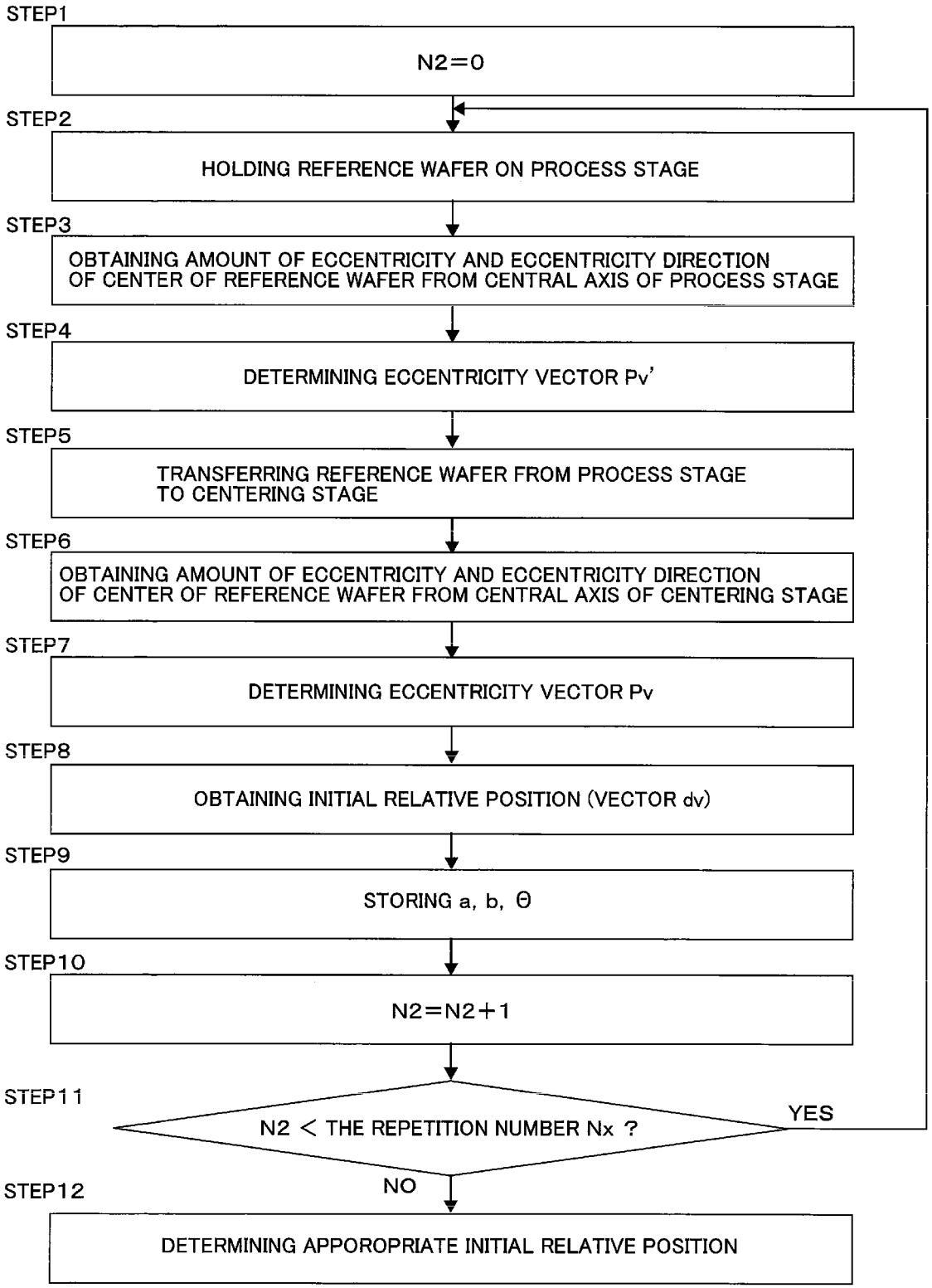
FIG. 21 is an operation flow chart illustrating a centering preparation operation performed in STEP 1 shown in FIG. 20.
Figure 22:
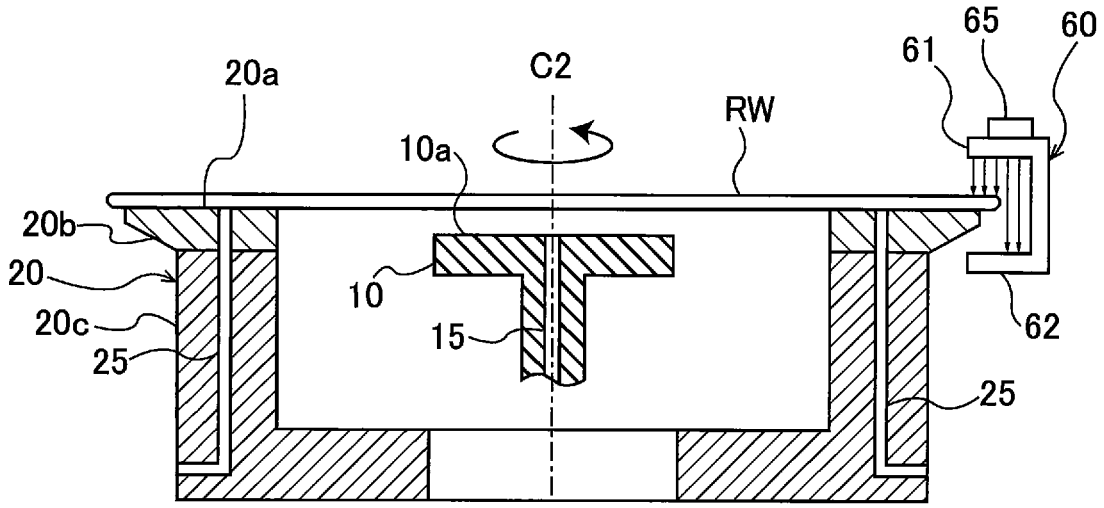
FIG. 22 is a diagram illustrating an operation of measuring an amount of eccentricity and an eccentricity direction of a center of a reference wafer from the central axis of the process stage.

FIG. 21 is an operation flow chart illustrating the centering preparation operation performed in STEP 1 of FIG. 20. In the operation flow chart shown in FIG. 21, N2 representing the number of reference wafers RW used for obtaining the initial relative position is set to 0 (see STEP 1 in FIG. 21). Next, as shown in FIG. 22, the reference wafer (or reference substrate) RW is placed on the process stage 20, and the reference wafer RW is held on the process stage 20 (see STEP 2 in FIG. 21). The reference wafer RW may be manually placed on the process stage 20 by operator of the polishing apparatus, or may be placed on the process stage 20 by use of hands 90 of the transport mechanism shown in FIGS. 4 and 5. Alternatively, after the reference wafer RW is transported to the centering stage 10, located at the elevated position, by hands 90 of the transport mechanism, the centering stage 10 may be lowered to place the reference wafer RW on the process stage 20. The reference wafer RW may be either a wafer to be polished or another wafer having the same size as a wafer to be polished.

The reference wafer RW is held on the second substrate holding surface 20*a* of the process stage 20 by vacuum suction as described above. In this state, the process stage 20, together with the reference wafer RW held thereon, is forced to make one revolution by the prosecco-stage rotating mechanism 56 (see FIG. 1), and the amount of eccentricity and the eccentricity direction (i.e., the maximum eccentric angle) of a center RC of the reference wafer RW from the central axis C2 of the process stage 20 is obtained by the eccentricity detector 60 (see STEP 3 in FIG. 21).

Figure 23:
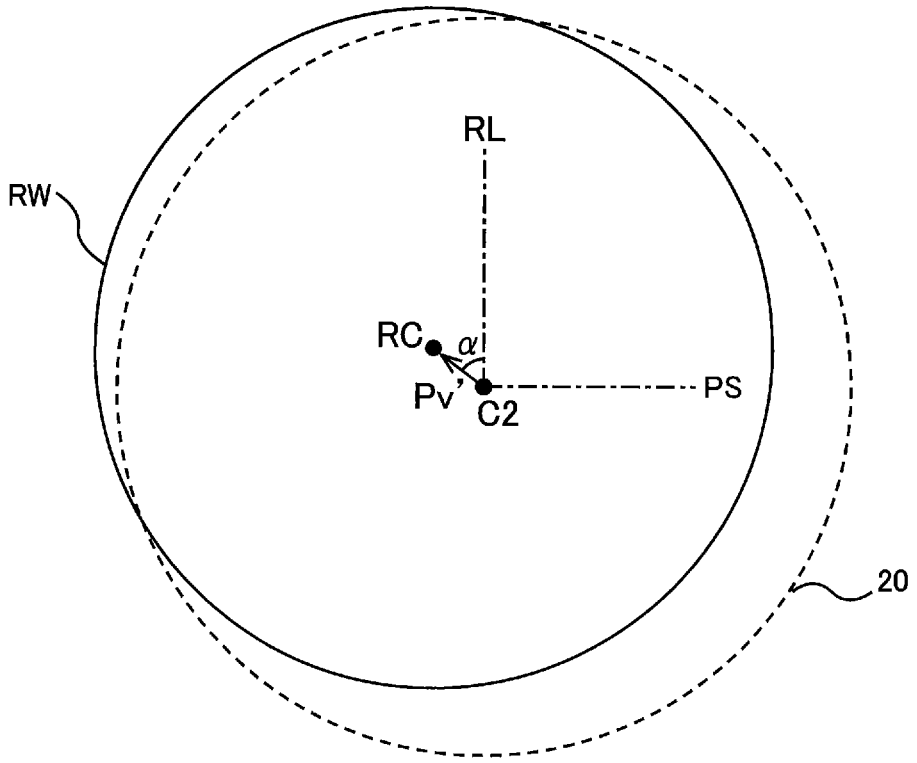
FIG. 23 is a diagram showing the amount of eccentricity and the eccentricity direction of the center of the reference wafer from the central axis of the process stage.

As shown in FIG. 23, the eccentricity detector 60 calculates the amount of eccentricity and the eccentricity direction (i.e., the maximum eccentric angle) of the center RC of the reference wafer RW from the central axis C2 of the process stage 20, thus determining an eccentricity vector Pv' (see STEP 4 in FIG. 21). The amount of eccentricity is a magnitude |Pv'| of the eccentricity vector Pv', and corresponds to a distance from the central axis C2 of the process stage 20 to the center RC of the reference wafer RW. The eccentricity direction is represented by an angle $\alpha$ of the eccentricity vector Pv' with respect to an angle reference line RL which extends through the central axis C2 of the process stage 20 and is perpendicular to a process-stage reference axis PS. The process-stage reference axis PS is parallel to the offset axis OS.

Figure 24:
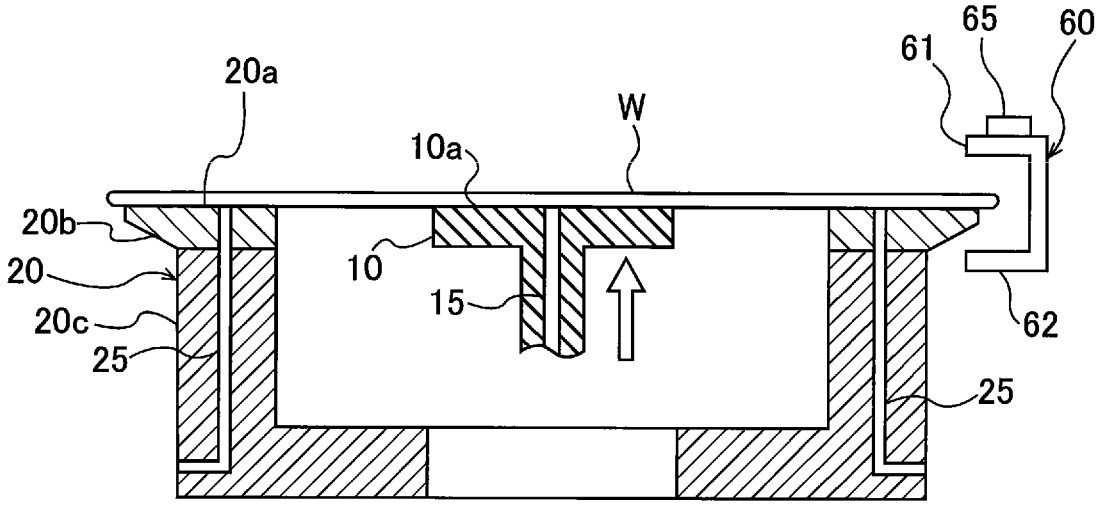
FIG. 24 is a diagram illustrating an operation of transferring the reference wafer from the process stage to a centering stage.

After the eccentricity vector Pv' is determined, the centering stage 10 is elevated until the first substrate holding surface 10*a* of the centering stage 10 is brought into contact with a center-side area of a lower surface of the reference wafer RW as shown in FIG. 24. A vacuum is then created in the first vacuum line 15, whereby the center-side area of the lower surface of the reference wafer RW is held on the centering stage 10 by vacuum suction. Thereafter, the second vacuum lines 25 are ventilated, so that the reference wafer RW can be separated from the process stage 20. Thus, the reference wafer W is transferred from the process stage 20 to the centering stage 10 (see STEP 5 in FIG. 21). After the reference wafer RW is transferred from the process stage 20 to the centering stage 10, the centering stage 10 is elevated together with the reference wafer RW until the reference wafer RW reaches the above-described eccentricity detecting position.

Figure 25:
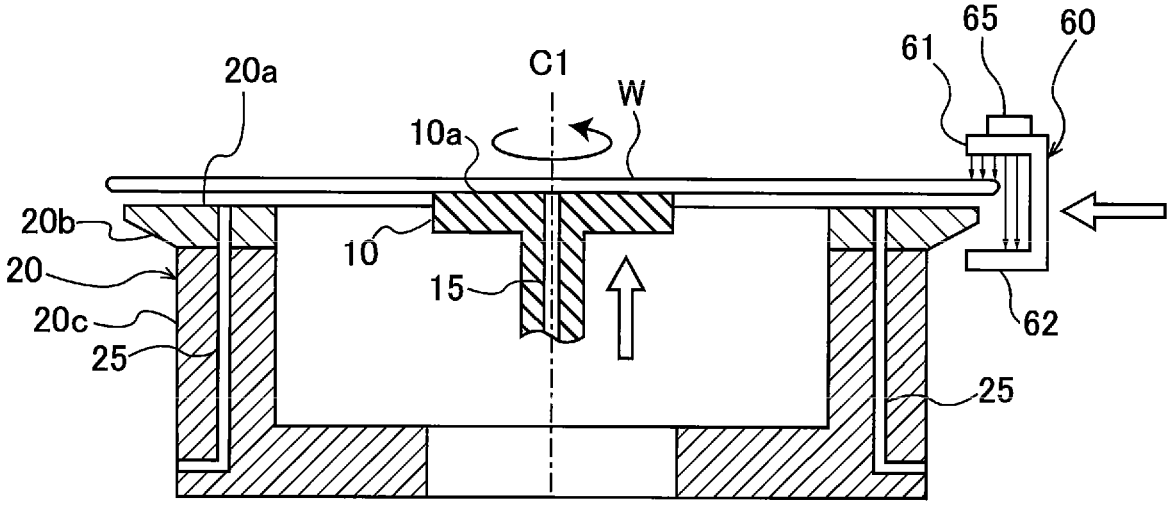
FIG. 25 is a diagram illustrating an operation of measuring an amount of eccentricity and an eccentricity direction of the center of the reference wafer from the central axis of the centering stage.
Figure 26:
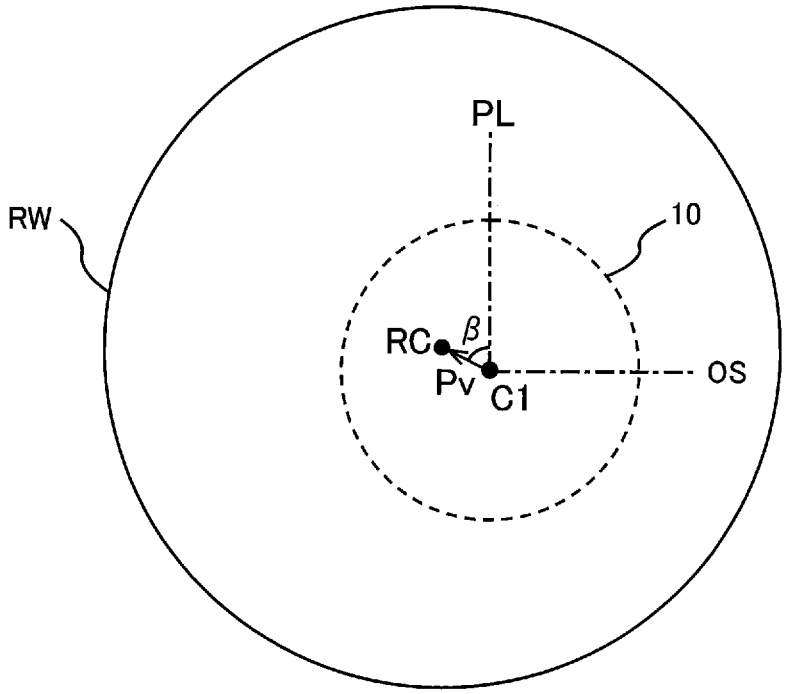
FIG. 26 is a diagram showing the amount of eccentricity and the eccentricity direction of the center of the reference wafer from the central axis of the centering stage.

As shown in FIG. 25, the centering stage 10, together with the reference wafer RW, is rotated about the central axis C1 of the centering stage 10, and the amount of eccentricity and the eccentricity direction (i.e., the maximum eccentric angle) of the center RC of the reference wafer RW from the central axis C1 of the centering stage 10 is obtained by the eccentricity detector 60 (see STEP 6 in FIG. 21). As shown in FIG. 26, an eccentricity vector Pv of the center RC of the reference wafer RW from the central axis C1 of the centering stage 10 is determined (see STEP 7 in FIG. 21). The amount of eccentricity is a magnitude |Pv| of the eccentricity vector Pv, and corresponds to a distance from the central axis C1 of the centering stage 10 to the center RC of the reference wafer RW. The eccentricity direction is represented by an angle β of the eccentricity vector Pv with respect to an angle reference line PL which extends through the central axis C1 of the centering stage 10 and is perpendicular to the offset axis OS. The angle reference line PL shown in FIG. 26 and the angle reference line RL shown in FIG. 23 are horizontal lines parallel to each other.

As described above, the eccentricity detector 60 is coupled to the operation controller 75 shown in FIG. 1. The amounts of eccentricity (|Pv'|, |Pv|) and the eccentricity directions (angle α, angle β), which specify the eccentricity vector Pv' and the eccentricity vector Pv, are sent to the operation controller 75. From the eccentricity vector Pv' and the eccentricity vector Pv, the operation controller 75 calculates the initial relative position of the central axis C1 of the centering stage 10 with respect to the central axis C2 of the process stage 20.

Figure 27:
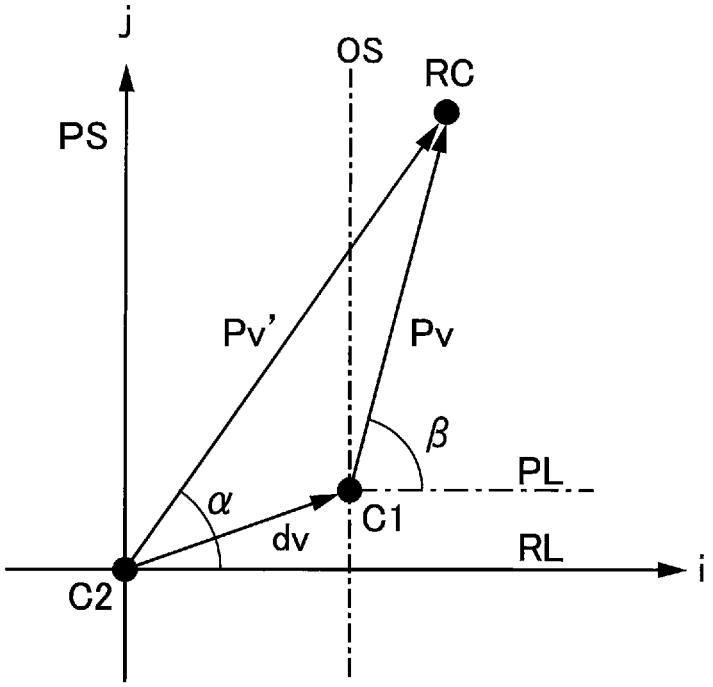
FIG. 27 is a diagram showing a positional relationship between the central axis of the centering stage, the central axis of the process stage, and the center of the reference wafer.

FIG. 27 is a diagram showing the eccentricity vector Pv' and the eccentricity vector Pv. The position of the reference wafer RW does not change when the reference wafer RW is transferred from the process stage 20 to the centering stage 10. Accordingly, the position of the center RC of the reference wafer RW held on the process stage 20 shown in FIG. 22 is identical to the position of the center RC of the reference wafer RW held on the centering stage 10 shown in FIG. 25. In other words, a position of an end point of the eccentricity vector Pv' coincides with a position of an end point of the eccentricity vector Pv.

In FIG. 27, the initial relative position of the central axis C1 of the centering stage 10 with respect to the central axis C2 of the process stage 20 is indicated by a vector dv. This vector dv can be determined as follows:

$$dv = Pv' - Pv \tag{1}$$

When each of the eccentricity vector Pv' and the eccentricity vector Pv is resolved into an i-direction vector on the angle reference line RL and a j-direction vector on the process-stage reference axis PS which is perpendicular to the angle reference line RL, the eccentricity vector Pv' and the eccentricity vector Pv can be expressed as $$Pv' = (|Pv'|\cos\alpha)iv + (|Pv'|\sin\alpha)jv \tag{2}$$

$$Pv = (|Pv|\cos\beta)iv + (|Pv|\sin\beta)jv \tag{3}$$

where |Pv'| represents the amount of eccentricity of the center RC of the reference wafer RW from the central axis C2 of the process stage 20, |Pv| represents the amount of eccentricity of the center RC of the reference wafer RW from the central axis C1 of the centering stage 10, a represents the angle of the eccentricity vector Pv' with respect to the angle reference line RL, β represents the angle of the eccentricity vector Pv with respect to the angle reference line PL, iv represents an i-direction vector, and jv represents a j-direction vector.

As can be seen from FIG. 27, the angle α indicates the eccentricity direction of the center RC of the reference wafer RW from the central axis C2 of the process stage 20, and the angle β indicates the eccentricity direction of the center RC of the reference wafer RW from the central axis C1 of the centering stage 10.

From the above equations (2) and (3), the vector dv, which indicates the initial relative position of the central axis C1 of the centering stage 10 with respect to the central axis C2 of the process stage 20, can be determined as follows:

$$\begin{aligned} dv &= Pv' - Pv \\ &= (|Pv'|\cos\alpha - |Pv|\cos\beta)iv + (|Pv'|\sin\alpha - |Pv|\sin\beta)jv \\ &= aiv + bjv \end{aligned} \tag{4}$$

$$a = |Pv'|\cos\alpha - |Pv|\cos\beta \tag{5}$$

$$b = |Pv'|\sin\alpha - |Pv|\sin\beta \tag{6}$$

$$\theta = \tan^{-1}(b/a) \tag{7}$$

Figure 28:
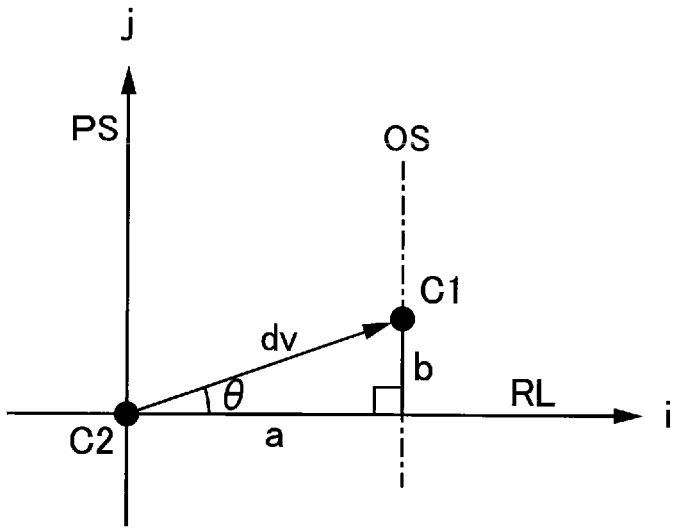
FIG. 28 is a diagram showing an initial relative position of the central axis of the centering stage with respect to the central axis of the process stage.

As shown in FIG. 28, the initial relative position of the central axis C1 of the centering stage 10 with respect to the central axis C2 of the process stage 20 can be expressed by using factors a, b, θ that specify the vector dv. The initial relative position (i.e., the vector dv) of the central axis C1 of the centering stage 10 with respect to the central axis C2 of the process stage 20 can thus be obtained (see STEP 8 in FIG. 21). Numerical values of the factors a, b, θ that specify the initial relative position are inherent to the polishing apparatus. The numerical values of the factors a, b, θ that specify the initial relative position are stored in the operation controller 75 (see STEP 9 in FIG. 21).

In this embodiment, obtaining of the initial relative position of the central axis C1 of the centering stage 10 with respect to the central axis C2 of the process stage 20 is performed for a plurality of reference wafers RW. Therefore, the operation controller 75 stores in advance Nx corresponding to the repetition number of the series of operations shown in the above-described STEPS 1 through 9.

The operation controller 75 adds 1 to N2 representing the number of the reference wafer RW for obtaining the initial relative position (see STEP 10 in FIG. 21). Further, the operation controller 75 compares N2 with the predetermined repetition number Nx (see STEP 11 in FIG. 21). When N2 does not reach the repetition number Nx (see YES of STEP 11 in FIG. 21), new reference wafer RW is held on the process stage 20 (see STEP 2 in FIG. 21). The new reference wafer RW may be different from or the same as the reference wafer RW that has been used for obtaining the previous initial relative position.

Next, the operation controller 75 causes the eccentricity detector 60 to obtain the amount of eccentricity and the eccentricity direction of the center RC of the reference wafer RW from the central axis C2 of the process stage 20 (see STEP 3 in FIG. 21), and to determine the eccentricity vector Pv' that specifies these amount of eccentricity and eccentricity direction (see STEP 4 in FIG. 21). Next, the operation controller 75 causes the reference wafer RW to be held on the centering stage 10 (see STEP 5 in FIG. 21), and then the eccentricity detector 60 to obtain the amount of eccentricity and the eccentricity direction of the center RC of the reference wafer RW from the central axis C1 of the centering stage 10 (see STEP 6 in FIG. 6). Further, the operation controller 75 causes the eccentricity detector 60 to determine the eccentricity vector Pv that specifies these amount of eccentricity and eccentricity direction (see STEP 7 in FIG. 21). Next, the operation controller 75 obtains the initial relative position (i.e., the vector dv) of the central axis C1 of the centering stage 10 with respect to the central axis C2 of the process stage 20 (see STEP 8 in FIG. 21), and further stores numerical values of the factors a, b, θ that specify the initial relative position (see STEP 9 in FIG. 21).

When N2 reaches the repetition number Nx (see NO of STEP 8 in FIG. 21), the operation controller 75 determines an optimum initial relative position based on numerical values of the factors a, b, θ that specify a plurality of initial relative positions, respectively (see STEP 12 in FIG. 21). For example, the operation controller 75 calculates each average value of the numerical values of the factors a, b, θ that specify the plurality of initial relative positions.

In this manner, the factors a, b, θ that specify the initial relative position of the central axis C1 of the centering stage 10 with respect to the central axis C2 of the process stage 20 is determined. The initial relative position of the central axis C1 of the centering stage 10 with respect to the central axis C2 of the process stage 20 is a positional deviation due to the structure of the polishing apparatus. In this embodiment, in STEP 1 shown in FIG. 20, the initial relative position of the central axis C1 of the centering stage 10 with respect to the central axis C2 of the process stage 20 is determined, and next the operation controller 75 sets N representing the repetition number of centering operation, which will be described hereinafter, to 0 (see STEP 2 in FIG. 20). Next, the operation controller 75 causes the wafer W to be transported to the centering stage 10 as shown in FIG. 4 (see STEP 3 in FIG. 20), and to be held on the centering stage 10 (see STEP 4 in FIG. 20).

Next, the operation controller 75 causes the centering stage 10 to be lowered to the eccentricity detecting position as shown in FIG. 6, and obtains the amount of eccentricity and the eccentricity direction of the center of the wafer W from the central axis C1 of the centering stage 10 by use of the eccentricity detector 60 as described above (see STEP 5 in FIG. 20). Next, the centering operation for aligning the center of the wafer W with the central axis C2 of the process stage 20 is performed (see STEP 6 in FIG. 20). In this embodiment, the centering operation is performed as follows.

Figure 29:
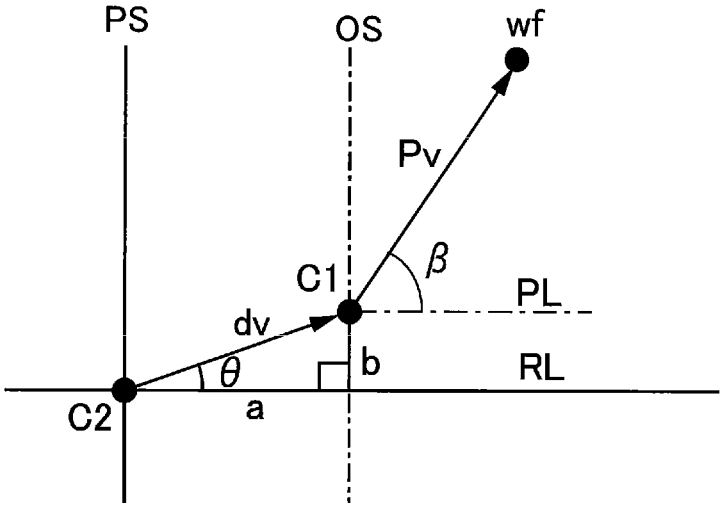
FIG. 29 is a diagram showing a positional relationship between the central axis of the process stage, the central axis of the centering stage, and the center of the wafer.

FIG. 29 is a diagram showing a positional relationship between the central axis C2 of the process stage 20, the central axis C1 of the centering stage 10, and the center wf of the wafer W. The amount of eccentricity of the center wf of the wafer W from the central axis C1 of the centering stage 10 is represented by a distance from the central axis C1 of the centering stage 10 to the center wf of the wafer W, i.e. the magnitude |Pv| of the eccentricity vector Pv. The eccentricity direction of the center wf of the wafer W from the central axis C1 of the centering stage 10 is represented by the angle β of the eccentricity vector Pv with respect to the angle reference line PL. The determined amount of eccentricity (|Pv|) and the determined eccentricity direction (angle β) of the wafer W are sent to the operation controller 75.

Based on the initial relative position of the central axis C1 of the centering stage 10 with respect to the central axis C2 of the process stage 20, and based on the amount of eccentricity |Pv| and the eccentricity direction (angle β) of the wafer W, the operation controller 75 calculates a distance by which the centering stage 10 is to be moved along the offset axis OS and an angle through which the centering stage 10 is to be rotated, which are necessary for the center wf of the wafer W to be located on the central axis C2 of the process stage 20. The moving mechanism 41 and the centering-stage rotating mechanism 36 move and rotate the centering stage 10 until the center wf of the wafer W on the centering stage 10 is located on the central axis C2 of the process stage 20.

Figure 30:
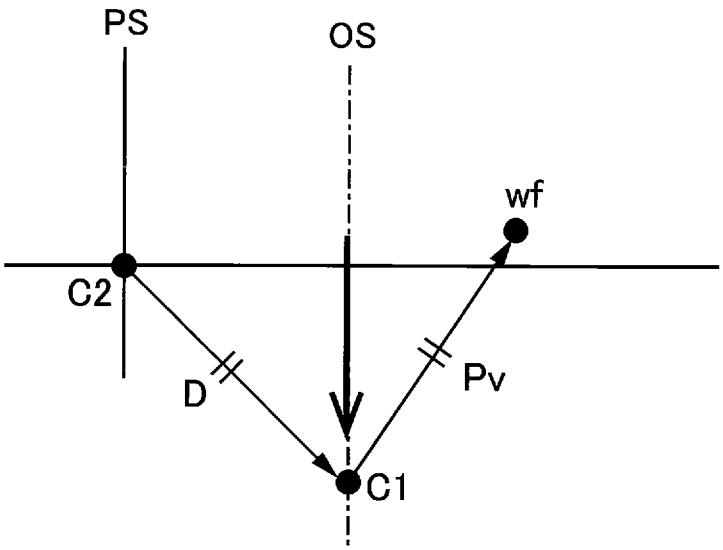
FIG. 30 is a diagram illustrating an operation of moving the centering stage along an offset axis by a distance calculated by an operation controller.
Figure 31:
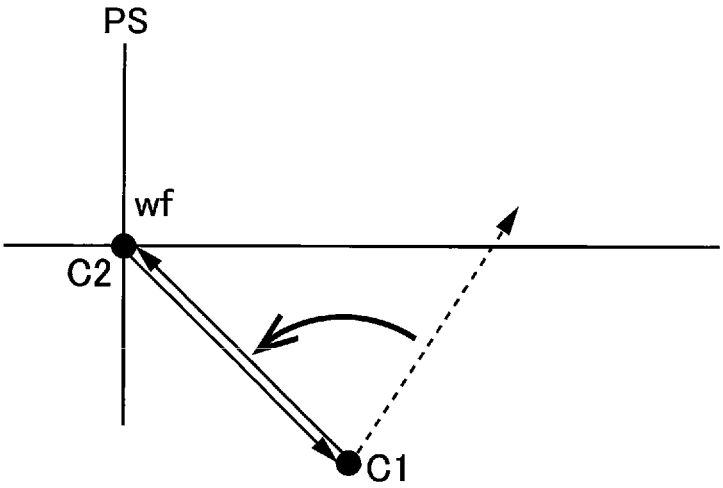
FIG. 31 is a diagram illustrating an operation of rotating the centering stage together with the wafer through an angle calculated by the operation controller.

FIG. 30 is a diagram illustrating an operation of the moving mechanism 41 when moving the centering stage 10 along the offset axis OS by the distance calculated by the operation controller 75. As shown in FIG. 30 the moving mechanism 41 moves the centering stage 10 horizontally along the offset axis OS until the distance between the central axis C1 of the centering stage 10 and the central axis C2 of the process stage 20 becomes equal to the amount of eccentricity |Pv|. Further, as shown in FIG. 31, the centering-stage rotating mechanism 36 rotates the centering stage 10, together with the wafer W, through the angle calculated by the operation controller 75. More specifically, the centering-stage rotating mechanism 36 rotates the centering stage 10 until the center wf of the wafer W on the centering stage 10 lies on a straight line PS which extends through the central axis C2 of the process stage 20 and extends parallel to the offset axis OS.

In this manner, the center wf of the wafer W on the centering stage 10 can be located on the central axis C2 of the process stage 20 by the horizontal movement of the centering stage 10 along the offset axis OS and the rotation of the centering stage 10. In this embodiment also, the centering-stage rotating mechanism 36, the moving mechanism 41 and the operation controller 75 constitute an aligner for performing the centering operation of moving and rotating the centering stage 10 until the center wf of the wafer W on the centering stage 10 is located on the central axis C2 of the process stage 20. In one embodiment, the rotation of the centering stage 10 may be performed first, followed by the movement of the centering stage 10 along the offset axis OS. In order to complete the centering operation in a shorter time, the moving mechanism 41 and the centering-stage rotating mechanism 36 may simultaneously perform the horizontal movement of the centering stage 10 along the offset axis OS and the rotation of the centering stage 10.

After completion of the above-described centering operation, the operation controller 75 causes the wafer W to be transferred from the centering stage 10 to the process stage 20 as shown in FIG. 12 (see STEP 7 in FIG. 20). Next, the operation controller 75 obtains the amount of eccentricity and the eccentricity direction of the center of the wafer W, held on the process stage 20, from the central axis of the process stage 20 by use of the above-described eccentricity detecting mechanism 54 (see STEP 8 in FIG. 20), and determines whether or not the obtained amount of eccentricity is within the predetermined allowable range (see STEP 9 in FIG. 20).

When the amount of eccentricity of the center of the wafer W, held on the process stage 20, from the central axis of the process stage 20 is within the allowable range, the operation controller 75 performs polishing of the peripheral portion of the wafer W (see STEP 10 in FIG. 20). When the amount of eccentricity of the center of the wafer W, held on the process stage 20, from the central axis of the process stage 20 is out of the allowable range, the centering operation is repeated until the number N of centering operation reaches the repetition number NA, as described with reference to FIGS. 2 and 3.

In this manner, in this embodiment also, after the wafer W is transferred from the centering stage 10 to the process stage 20, it is confirmed whether or not the amount of eccentricity of the center of the wafer W from the central axis C2 of the process stage 20 is within the predetermined allowable range. Therefore, a defective wafer W polished beyond the allowable polishing width can be prevented from being produced.

The initial relative position of the central axis C1 of the centering stage 10 with respect to the central axis C2 of the process stage 20 does not change basically. However, the positional deviation can change as a large number of wafers are polished. In order to correct such positional deviation, mechanical adjustment (i.e. positional adjustment manually conducted by an operator) was conventionally needed. According to this embodiment, an influence of a change in the initial relative position can be eliminated by performing the above-described process of calculating automatically the initial relative position, and by updating the factors a, b, θ which have been stored in the operation controller 75 and represent the initial relative position. This embodiment thus does not require the manual positional adjustment by an operator, and can therefore reduce downtime of the polishing apparatus.

Figure 32:
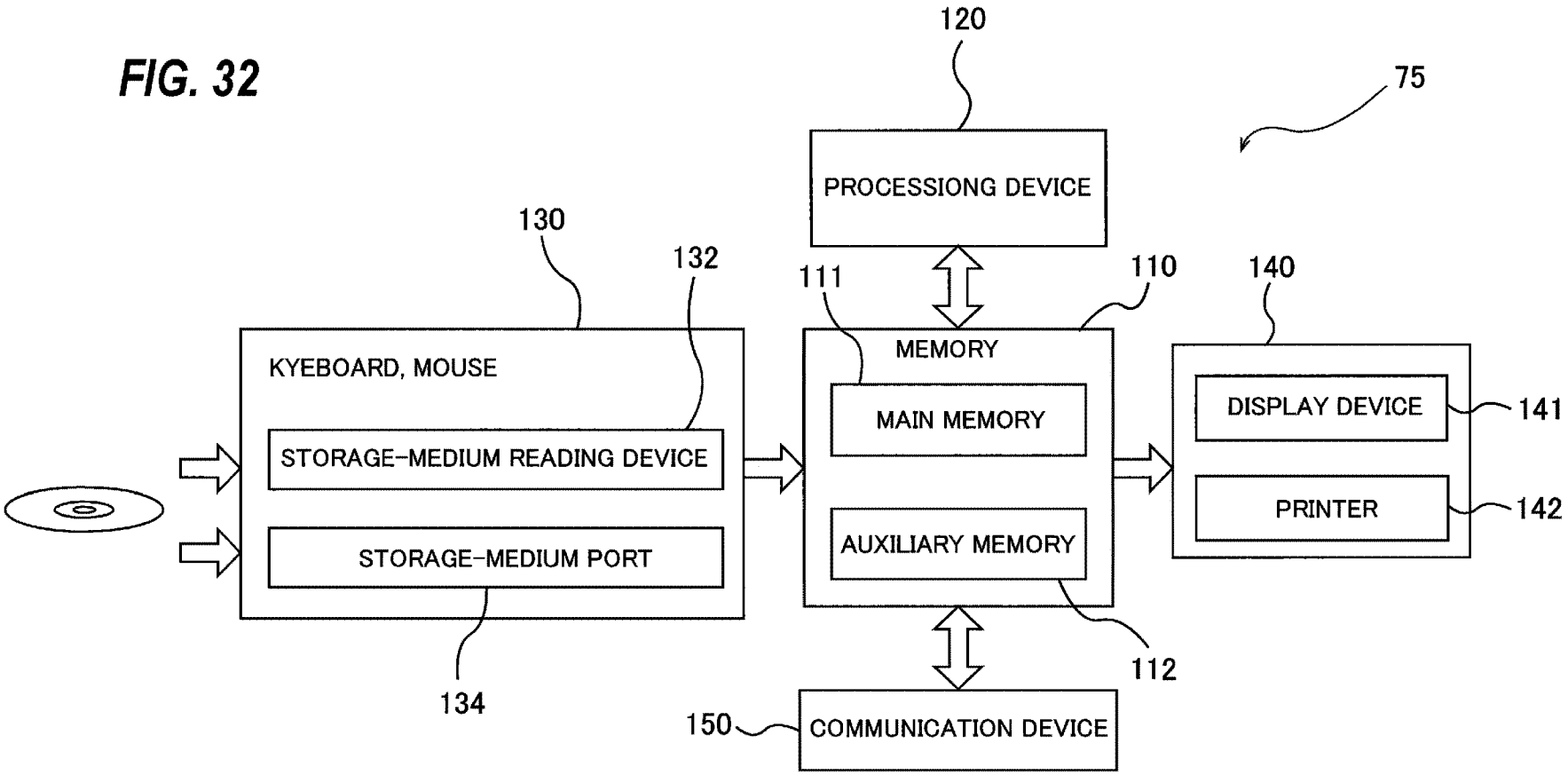
FIG. 32 is a schematic view showing an example of the operation controller shown in FIG. 1.

FIG. 32 is a schematic view showing an example of the operation controller 75 shown in FIG. 1. The operation controller 75 shown in FIG. 32 is a dedicated computer or a general-purpose computer. The operation controller 75 shown in FIG. 32 includes a memory 110 in which a program and data are stored, a processing device 120, such as CPU (central processing unit) or GPU (graphics processing unit), for performing arithmetic operation according to the program stored in the memory 110, an input device 130 for inputting the data, the program, and various information into the memory 110, an output device 140 for outputting processing results and processed data, and a communication device 150 for connecting to a network, such as the Internet.

The memory 110 includes a main memory 111 which is accessible by the processing device 120, and an auxiliary memory 112 that stores the data and the program therein. The main memory 111 may be a random-access memory (RAM), and the auxiliary memory 112 is a storage device which may be a hard disk drive (HDD) or a solid-state drive (SSD).

The input device 130 includes a keyboard and a mouse, and further includes a storage-medium reading device 132 for reading the data from a storage medium, and a storage-medium port 134 to which a storage medium can be connected. The storage medium is a non-transitory tangible computer-readable storage medium. Examples of the storage medium include optical disk (e.g., CD-ROM, DVD-ROM) and semiconductor memory (e.g., USB flash drive, memory card). Examples of the storage-medium reading device 132 include optical drive (e.g., CD drive, DVD drive) and card reader. Examples of the storage-medium port 134 include USB terminal. The program and/or the data stored in the storage medium is introduced into the computer via the input device 130, and is stored in the auxiliary memory 112 of the memory 110. The output device 140 includes a display device 141 and a printer 142.

The operation controller 75 performs polishing process, including the above-described centering operation, according to the program electrically stored in the memory 110. Specifically, the operation controller 75 operates the eccentricity detector 60 (or the eccentricity detector 60A) of the eccentricity detecting mechanism 54 to obtain the amount of eccentricity and the eccentricity direction of the center of the wafer W, held on the centering stage 10 located at the eccentricity detecting position, from the central axis C1 of the centering stage 10; operates the aligner to align the center of the wafer W, held on the centering stage 10, with the central axis C2 of the process stage 20; operates the stage elevating mechanism 51 to transfer the wafer W from the centering stage 10 to the process stage 20 and be held on the process stage 20; operates the eccentricity detector 60 (or the eccentricity detector 60B) of the eccentricity detecting mechanism 54 to obtain the amount of eccentricity and the eccentricity direction of the center of the wafer W, held on the process stage 20, from the central axis C2 of the process stage 20; confirms whether or not the amount of eccentricity of the center of the wafer W, held on the process stage 20, from the central axis C2 of the process stage 20 is within the predetermined allowable range; and starts polishing of the peripheral portion of the wafer W when the amount of eccentricity of the center of the wafer W from the central axis C2 of the process stage 20 is within the predetermined allowable range. As described above, the operation controller 75 may perform the centering preparation operation before performing the centering operation. In this case, the centering operation is performed based on the initial relative position of the central axis C1 of the centering stage 10 with respect to the central axis C2 of the process stage 20, and based on the amount of eccentricity |Pv| and the eccentricity direction (angle β) of the wafer W.

When the amount of eccentricity of the center of the wafer W from the central axis C2 of the process stage 20 is out of the predetermined allowable range, the operation controller 75 performs a retry operation for aligning the center of the wafer W with the central axis C2 of the process stage 20 again. Specifically, the operation controller 75 causes the wafer W to be transferred from the process stage 20 to the centering stage 10 and to be held on the centering stage 10; operates the eccentricity detector 60 (or the eccentricity detector 60A) of the eccentricity detecting mechanism 54 to obtain the amount of eccentricity and the eccentricity direction of the center of the wafer W, held on the centering stage 10 located at the eccentricity detecting position, from the central axis C1 of the centering stage 10; operates the aligner to align the center of the wafer W, held on the centering stage 10, with the central axis C2 of the process stage 20; operates the stage elevating mechanism 51 to transfer the wafer W from the centering stage 10 to the process stage 20 and to be held on the process stage 20; operates the eccentricity detector 60 (or the eccentricity detector 60B) of the eccentricity detecting mechanism 54 to obtain the amount of eccentricity and the eccentricity direction of the center of the wafer W, held on the process stage 20, from the central axis C2 of the process stage 20; and confirms whether or not the amount of eccentricity of the center of the wafer W, held on the process stage 20, from the central axis C2 of the process stage 20 is within the predetermined allowable range. The retry operation may omit obtaining of the amount of eccentricity and the eccentricity direction of the center of the wafer W, held on the centering stage 10 located at the eccentricity detecting position, from the central axis C1 of the centering stage 10. In this case, the operation controller 75 causes the process stage 20 to be rotated based on the amount of eccentricity and the eccentricity direction of the center of the wafer W from the central axis C2 of the process stage 20, which has been obtained after the previous centering operation; causes the wafer W to be transferred from the process stage 20 to the centering stage 10, and further causes the wafer W held on the centering stage 10 to be moved.

Each time the eccentricity detector 60 of the eccentricity detecting mechanism 54 obtains the amount of eccentricity and the eccentricity direction of the center of the wafer W from the central axis C1 of the centering stage 10, and the amount of eccentricity and the eccentricity direction of the center of the wafer W, held on the process stage 20, from the central axis C2 of the process stage 20, the operation controller 75 stores these amount of eccentricity and eccentricity direction in the memory 110. Thus, data set, which comprises of a plurality of the amounts of eccentricity and the eccentricity directions of the center of the wafer W from the central axis C1 of the centering stage 10, and a plurality of the amounts of eccentricity and the eccentricity directions of the center of the wafer W, held on the process stage 20, from the central axis C2 of the process stage 20, is stored in the memory 110 of the operation controller 75. Further, the operation controller 75 stores in the memory 110, an amount of movement and an amount of rotation of the centering stage 10 which are calculated for locating the center of the wafer W on the central axis C2 of the process stage 20. Therefore, in the memory 110 of the operation controller 75, data set which comprises of a combination of the amount of movement and the amount of rotation of the centering stage 10 for locating the center of the wafer W on the central axis C2 of the process stage 20 is stored.

The program for causing the operation controller 75 to perform the above-described steps is stored in a non-transitory tangible computer-readable storage medium. The operation controller 75 is provided with the program via the storage medium. The operation controller 75 may be provided with the program via communication network, such as the Internet.

The operation controller 75 may determine the amount of movement and the amount of rotation of the centering stage 10 for aligning the center of the wafer W with the central axis C2 of the process stage 20 by use of artificial intelligence (AI). The artificial intelligence performs a machine learning using a neural network, or quantum computing to construct a learned model.

Figure 33:
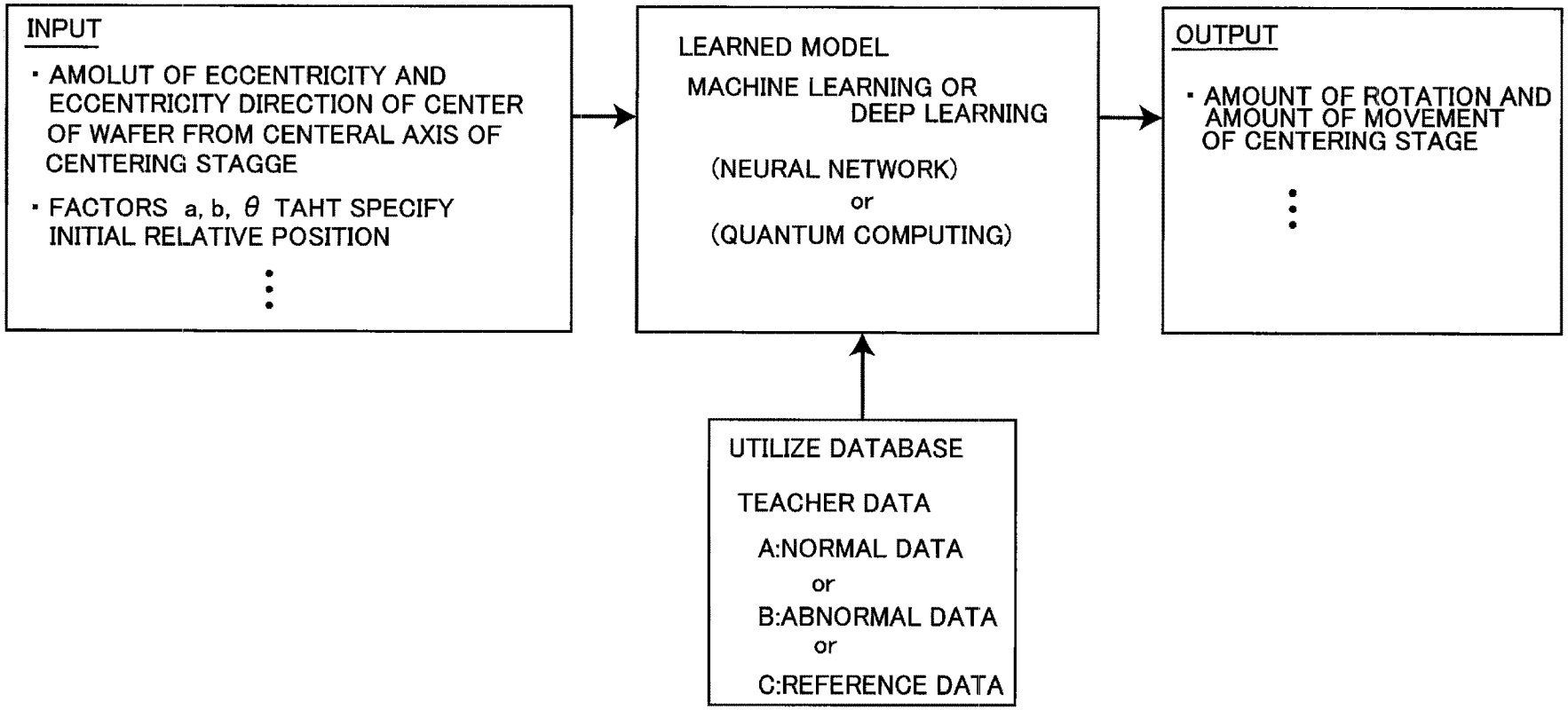
FIG. 33 is a schematic view showing an embodiment of a learned model for outputting a movement amount and a rotation amount of the centering stage.

FIG. 33 is a schematic view showing an embodiment of the learned model for outputting the movement amount and the rotation amount of the centering stage 10. As shown in FIG. 33, the machine learning for constructing the learned model uses teacher data. The teacher data used for the machine learning is data set for learning which is required when constructing a learned model for outputting an appropriate rotation amount and movement amount of the centering stage 10. This teacher data is, for example, normal data, abnormal data, or reference data. The teacher data is, for example, data set which includes the amount of eccentricity and the eccentricity direction of the center of the wafer W from the central axis C1 of the centering stage 10, the amount of movement and the amount of rotation of the centering stage 10 for aligning the center of the wafer W with the central axis C2 of the process stage 20, the amount of eccentricity and the eccentricity direction of the center of the wafer W, held on the process stage 20 after performing the centering operation, from the central axis C2 of the process stage 20, and the above-described allowable range. The teacher data is stored in advance in the memory 110 of the operation controller 75. The factors a, b, θ that specify the initial relative position may be added to the teacher data.

As the machine learning, a deep learning method is preferably used. The deep learning method is a neural-network-based learning method, and in the neural network, hidden layers (also referred to middle layers) are multilayered. In the present specification, a machine learning using a neural network constructed of an input layer, two or more hidden layers, and an output layer is referred to as deep learning.

Figure 34:
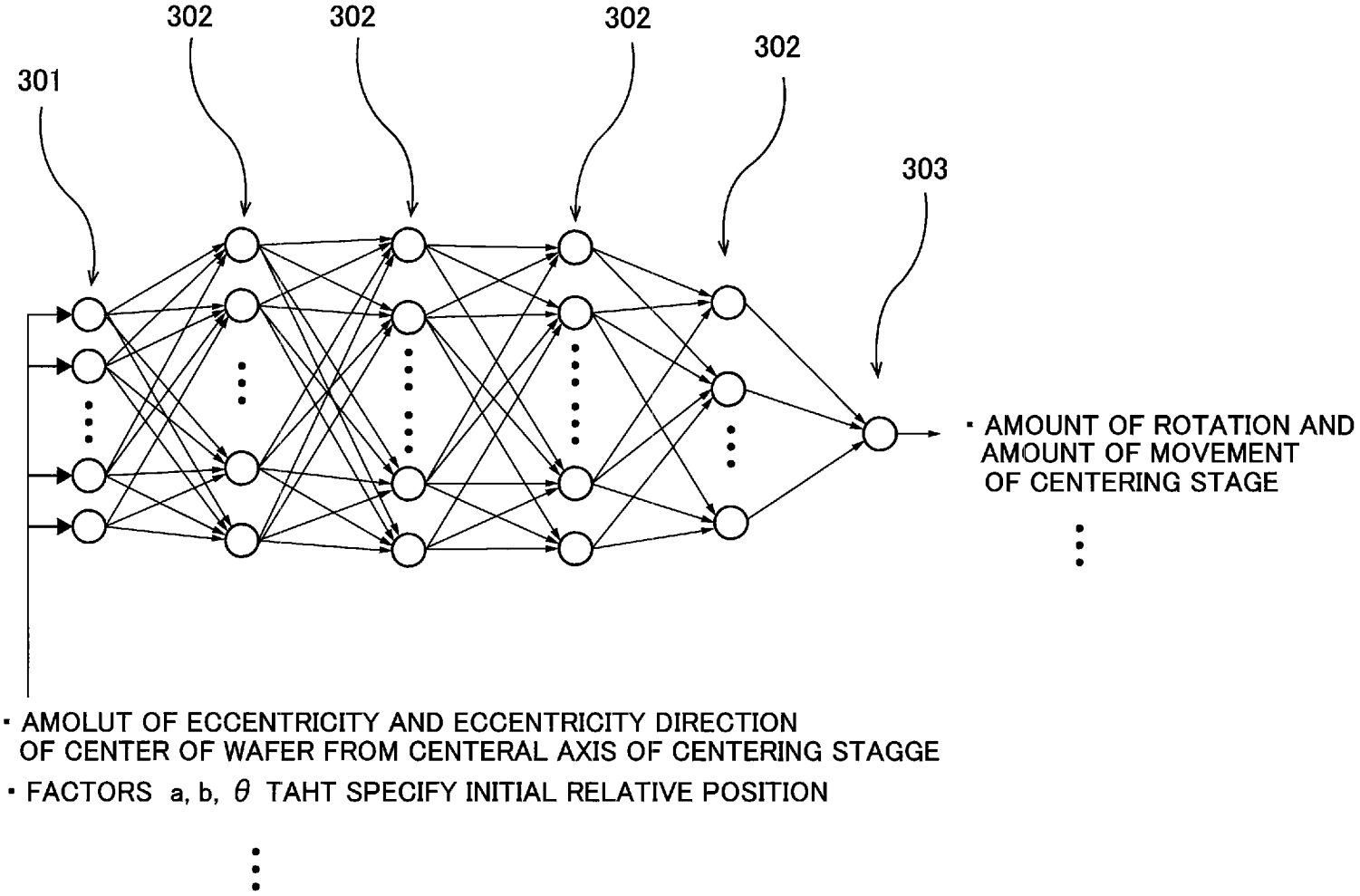
FIG. 34 is a schematic view showing an example of structure of neural network.
Figure 35:
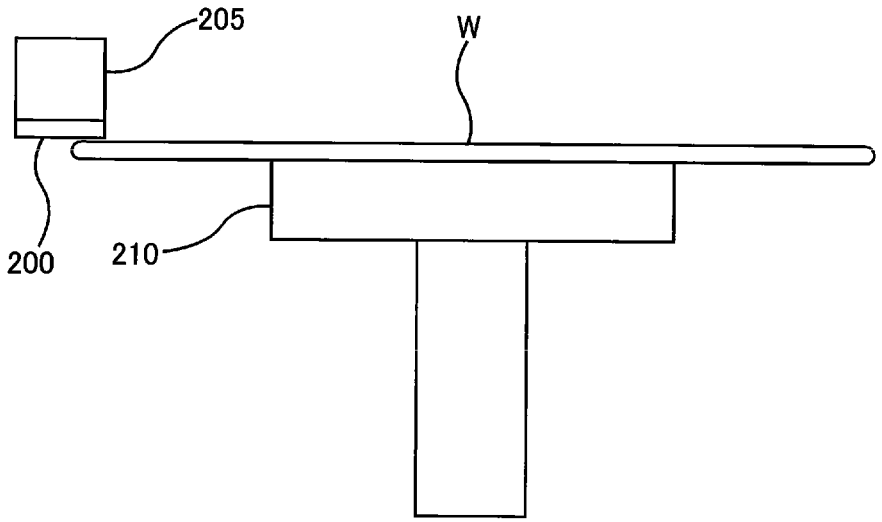
FIG. 35 is a schematic view of a conventional polishing apparatus.
Figure 36:
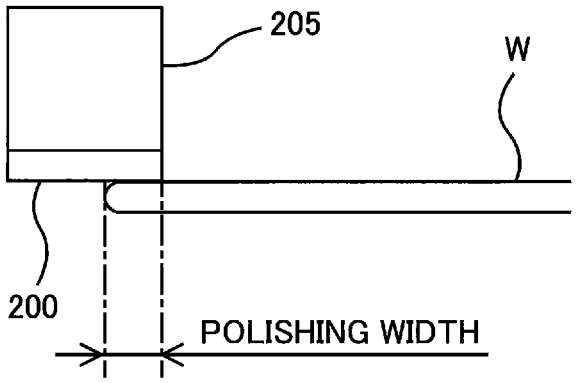
FIG. 36 is a diagram illustrating a polishing width of a wafer.

FIG. 34 is a schematic view showing an example of structure of neural network. The learned model is constructed by the deep learning method using the neural network as shown in FIG. 34. The neural network shown in FIG. 34 includes an input layer 301, a plurality of hidden layers (four hidden layers in the illustrated example) 302, and an output layer 303. When normal data is used as the teacher data, the operation controller 75 adjusts weight parameters for constructing the neural network by use of the normal data to construct the learned model. More specifically, the operation controller 75 adjusts the weight parameters of the neural network such that, when data including at least the amount of eccentricity and the eccentricity direction of the center of the wafer W from the central axis C1 of the centering stage 10 that have been prepared for learning, is inputted into the neural network, data corresponding to the appropriate amount of movement and the appropriate amount of rotation of the centering stage 10 is outputted from the neural network. In the above-described embodiment in which the factors a, b, θ for specifying the initial relative position are calculated, data set, inputted for constructing the learned model into the neural network, may further include factors a, b, θ for specifying the initial relative position, which has been prepared for learning.

The amount of movement and the amount of rotation of the centering stage 10 outputted from the output layer 303 are compared with a normal range. This normal range is a collection of data comprising of the amount of movement and the amount of rotation of the centering stage 10 when the amount of eccentricity of the center of the wafer W, held on the process stage 20 after performing the centering operation, from the central axis C2 of the process stage 20 is within the allowable range. In a case where the amount of movement and the amount of rotation of the centering stage 10 outputted from the output layer 303 is out of the normal range, the weight parameters are automatically adjusted such that, when date including at least the amount of eccentricity and the eccentricity direction of the center of the wafer W from the central axis C1 of the centering stage 10 that have been prepared for learning, is inputted into the neural network again, the amount of movement and the amount of the rotation of the centering stage 10 outputted from the output layer 303 are included in the normal range. In this manner, the learned model is constructed by repeatedly performing of inputting data, including at least the amount of eccentricity and the eccentricity direction of the center of the wafer W from the central axis C1 of the centering stage 10, into the input layer 301; comparing the amount of movement and the amount of rotation of the centering stage 10 outputted from the output layer 303, with the normal range; and adjusting the weight parameters. Further, the operation controller 75 preferably checks whether or not data which is, when training data for checking is inputted into the neural network, outputted from the neural network corresponds to data including the normal range.

The learned model constructed in this manner is stored in the memory 110 (see FIG. 32). The operation controller 75 operates according to the program electrically stored in the memory 110. Specifically, the processing device 120 of the operation controller 75 performs arithmetic operations: to input, in the input layer 301 of the learned model, data including at least the amount of eccentricity and the eccentricity direction of the center of the wafer W from the central axis C1 of the centering stage 10 (and the factors a, b, θ for specifying the initial relative position) obtained by the eccentricity detecting mechanism 54; predict, based on the inputted data, the appropriate amount of movement and the appropriate amount of rotation of the centering stage 10 for aligning the center of the wafer W with the central axis C2 of the process stage 20; and output this predicted amount of movement and amount of rotation of the centering stage 10 from the output layer 303.

When the amount of movement and the amount of the rotation of the centering stage 10 outputted from the output layer 303 are determined to be equivalent to data included in the normal range, the operation controller 75 stores, in the memory 111, these amount of movement and amount of the rotation of the centering stage 10 as additional teacher data. Further, the operation controller 75 performs the machine learning (i.e., deep learning) based on the teacher data and the additional teacher data to update the learned model. As a result, accuracy in the amount of movement and the amount of the rotation of the centering stage 10 outputted from the learned model can be improved.

Determining whether or not the amount of movement and the amount of the rotation of the centering stage 10 outputted from the output layer 303 are equivalent to data including in the normal range is performed as follows. The operation controller 75 performs the centering operation for aligning the center of the wafer W, held on the centering stage 10, with the central axis C2 of the process stage 20 based on the amount of movement and the amount of the rotation of the centering stage 10 outputted from the output layer 303. Next, the operation controller 75 operates the eccentricity detector 60 (or the eccentricity detector 60B) of the eccentricity detecting mechanism 54 to obtain the amount of eccentricity and the eccentricity direction of the center of the wafer W, transferred from the centering stage 10 to the process stage 20 after the centering operation, from the central axis C2 of the process stage 20. When the amount of eccentricity of the center of the wafer W, obtained by the eccentricity detector 60 (or the eccentricity detector 60B) of the eccentricity detecting mechanism 54, from the central axis C2 of the process stage 20 is within the predetermined allowable range, the operation controller 75 determines that the amount of movement and the amount of the rotation of the centering stage 10 outputted from the output layer 303 are equivalent to data including in the normal range. The operation controller 75 stores, in the memory 111, the amount of movement and the amount of the rotation of the centering stage 10 that have determined to be equivalent to data including in the normal range, as additional teacher data. On the other hand, when the amount of eccentricity of the center of the wafer W, obtained by the eccentricity detector 60 (or the eccentricity detector 60B), from the central axis C2 of the process stage 20 is out of the predetermined allowable range, the amount of movement and the amount of the rotation of the centering stage 10 outputted from the output layer 303 may be used or not as additional teacher data.

While the polishing apparatus has been described as an embodiment of the substrate processing apparatus, the substrate processing apparatus and the substrate processing method can also be applied to other apparatuses and methods for processing a substrate while holding the substrate, such as an apparatus and method for CVD, an apparatus and method for sputtering, etc.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A substrate processing apparatus comprising:

a centering stage configured to hold a first area of a lower surface of a substrate;

a process stage configured to hold a second area of the lower surface of the substrate;

a process-stage rotating mechanism configured to rotate the process stage about a central axis of the process stage;

an eccentricity detecting mechanism configured to obtain an amount of eccentricity and an eccentricity direction of a center of the substrate, when held on the centering stage, from a central axis of the centering stage; and an aligner configured to perform a centering operation for aligning the center of the substrate with the central axis of the process stage based on the amount of eccentricity and the eccentricity direction of the center of the substrate, held on the centering stage, from the central axis of the centering stage, wherein the process stage includes an increased diameter portion having an annular substrate holding surface forming a lip portion for holding the second area, and a decreased diameter portion supporting the increased diameter portion, the increased diameter portion having an outer diameter larger than an outer diameter of the decreased diameter portion, and wherein the aligner obtains, after the substrate is transferred from the centering stage to the process stage and held on the process stage, an amount of eccentricity and an eccentricity direction of the center of the substrate, held on the process stage, from the central axis of the process stage by use of the eccentricity detecting mechanism; and confirms that the obtained amount of eccentricity of the center of the substrate from the central axis of the process stage is within a predetermined allowable range.

2. The substrate processing apparatus according to claim 1, wherein the aligner repeats the centering operation when the obtained amount of eccentricity of the center of the substrate from the central axis of the process stage is out of the predetermined allowable range.

3. The substrate processing apparatus according to claim 1, wherein the eccentricity detecting mechanism includes an eccentricity detector configured to measure the amount of eccentricity and the eccentricity direction of the center of the substrate, held on the centering stage, from the central axis of the centering stage, and the amount of eccentricity and the eccentricity direction of the center of the substrate, held on the process stage, from the central axis of the process stage, the eccentricity detector is an optical eccentricity sensor which includes a light emitting section for emitting light, and a light receiving section for receiving the light emitting from the light emitting section, and a distance between the light emitting section and the light receiving section in a vertical direction is set so as to be greater than a distance between an upper surface of the substrate held on the centering stage which is located at an eccentricity detecting position and a periphery of the process stage.

4. The substrate processing apparatus according to claim 1, wherein the eccentricity detecting mechanism includes an eccentricity detector configured to measure the amount of eccentricity and the eccentricity direction of the center of the substrate, held on the centering stage, from the central axis of the centering stage, and the amount of eccentricity and the eccentricity direction of the center of the substrate, held on the process stage, from the central axis of the process stage, and the eccentricity detector includes an imaging device and a light projector for emitting light toward the imaging device.

5. The substrate processing apparatus according to claim 1, wherein the aligner includes:

a centering-stage rotating mechanism configured to rotate the centering stage until the eccentricity direction of the center of the substrate, held on the centering stage, from the central axis of the centering stage is parallel to a predetermined offset axis extending in a horizontal direction; and a moving mechanism configured to move the centering stage along the predetermined offset axis until the center of the substrate held on the centering stage is located on the central axis of the process stage.

6. The substrate processing apparatus according to claim 5, wherein the aligner further includes an operation controller for controlling operations of the moving mechanism and the centering-stage rotating mechanism, the operation controller includes:

a memory in which a learned model constructed by machine learning is stored; and a processing device configured to perform operation to output an amount of movement and an amount of rotation of the centering stage for aligning the center of the substrate with the central axis of the process stage, when the amount of eccentricity and the eccentricity direction of the center of the substrate, held on the centering stage, from the central axis of the centering stage is inputted into the learned model.

7. The substrate processing apparatus according to claim 1, wherein the aligner performs a centering preparation operation for obtaining an initial relative position of the central axis of the centering stage with respect to the central axis of the process stage by use of the eccentricity detecting mechanism, and performs the centering operation based on the initial relative position, and based on the amount of eccentricity and the eccentricity direction of the center of the substrate, held on the centering stage, from the central axis of the centering stage.

8. The substrate processing apparatus according to claim 7, wherein the aligner includes:

a centering-stage rotating mechanism configured to rotate the centering stage until the center of the substrate on the centering stage is located on a straight line which extends through the central axis of the process stage and extends parallel to a predetermined offset axis; and a moving mechanism configured to move the centering stage along the predetermined offset axis until the center of the substrate held on the centering stage is located on the central axis of the process stage.

9. The substrate processing apparatus according to claim 8, wherein the aligner further includes an operation controller for controlling operations of the moving mechanism and the centering-stage rotating mechanism, the operation controller includes:

a memory in which a learned model constructed by machine learning is stored; and a processing device configured to perform operation to output an amount of movement and an amount of rotation of the centering stage for aligning the center of the substrate with the central axis of the process stage, when the initial relative position and the amount of eccentricity and the eccentricity direction of the center of the substrate, held on the centering stage, from the central axis of the centering stage is inputted into the learned model.

10. The substrate processing apparatus according to claim 1, wherein an upper surface of the increased diameter portion constitutes the annular substrate holding surface, and the annular substrate holding surface has an outer diameter smaller than a diameter of the substrate.

11. The substrate processing apparatus according to claim 1, wherein the increased diameter portion is secured to the decreased diameter portion.

12. The substrate processing apparatus according to claim 1, wherein the increased diameter portion is formed integrally with the decreased diameter portion.

13. A substrate processing method comprising:

holding a first area of a lower surface of a substrate with a centering stage;

obtaining an amount of eccentricity and an eccentricity direction of a center of the substrate, when held on the centering stage, from a central axis of the centering stage;

performing a centering operation for aligning the center of the substrate with a central axis of a process stage, based on the amount of eccentricity and the eccentricity direction of the center of the substrate, held on the centering stage, from the central axis of the centering stage, the process stage including an increased diameter portion having an annular substrate holding surface forming a lip portion for holding a second area of the lower surface of the substrate, a decreased diameter portion supporting the increased diameter portion, and the increased diameter portion having an outer diameter larger than an outer diameter of the decreased diameter portion;

transferring the substrate from the centering stage to the process stage to be held on the process stage;

obtaining an amount of eccentricity and an eccentricity direction of the center of the substrate, held on the process stage, from the central axis of the process stage;

confirming that the obtained amount of eccentricity of the center of the substrate from the central axis of the process stage is within a predetermined allowable range; and processing the substrate while rotating the processing stage about the central axis of the processing stage, when the obtained amount of eccentricity of the center of the substrate from the central axis of the process stage is within the predetermined allowable range.

14. The substrate processing method according to claim 13, wherein the centering operation is repeated when the obtained amount of eccentricity of the center of the substrate from the central axis of the process stage is out of the predetermined allowable range.

15. The substrate processing method according to claim 13, wherein obtaining the amount of eccentricity and the eccentricity direction of the center of the substrate, held on the centering stage, from the central axis of the centering stage, and obtaining the amount of eccentricity and the eccentricity direction of the center of the substrate, held on the process stage, from the central axis of the process stage are performed by an eccentricity detector which is an optical eccentricity sensor including a light emitting section for emitting light, and a light receiving section for receiving the light emitting from the light emitting section; and a distance between the light emitting section and the light receiving section in a vertical direction is set so as to be greater than a distance between an upper surface of the substrate held on the centering stage and a periphery of the process stage.

16. The substrate processing method according to claim 13, wherein obtaining the amount of eccentricity and the eccentricity direction of the center of the substrate, held on the centering stage, from the central axis of the centering stage, and obtaining the amount of eccentricity and the eccentricity direction of the center of the substrate, held on the process stage, from the central axis of the process stage are performed by an eccentricity detector which includes an imaging device and a light projector for emitting light toward the imaging device.

17. The substrate processing method according to claim 13, wherein the centering operation includes:

an operation of rotating the centering stage until the eccentricity direction of the center of the substrate, held on the centering stage, from the central axis of the centering stage is parallel to a predetermined offset axis extending in a horizontal direction; and an operation of moving the centering stage along the predetermined offset axis until the center of the substrate held on the centering stage is located on the central axis of the process stage.

18. The substrate processing method according to claim 17, wherein the amount of eccentricity and the eccentricity direction of the center of the substrate, held on the centering stage, from the central axis of the centering stage are inputted into a learned model constructed by machine learning, and an amount of rotation and an amount of movement of the centering stage for aligning the center of the substrate with the central axis of the process stage are outputted from the learned model.

19. The substrate processing method according to claim 13, further comprising: before the centering operation, performing a centering preparation operation for obtaining an initial relative position of the central axis of the centering stage with respect to the central axis of the process stage, wherein the centering operation is performed based on the initial relative position, and based on the amount of eccentricity and the eccentricity direction of the center of the substrate, held on the centering stage, from the central axis of the centering stage.

20. The substrate processing method according to claim 19, wherein the centering operation includes:

an operation of rotating the centering stage until the center of the substrate on the centering stage is located on a straight line which extends through the central axis of the process stage and extends parallel to a predetermined offset axis; and an operation of moving the centering stage along the predetermined offset axis until a distance between the central axis of the centering stage and the central axis of the processing stage becomes equal to the amount of eccentricity of the center of the substrate, when held on the process stage, from the central axis of the process stage.

21. The substrate processing method according to claim 20, wherein the initial relative position and the amount of eccentricity and the eccentricity direction of the center of the substrate, held on the centering stage, from the central axis of the centering stage are inputted into a learned model constructed by machine learning, and an amount of rotation and an amount of movement of the centering stage for aligning the center of the substrate with the central axis of the process stage are outputted from the learned model.

22. A substrate processing apparatus, comprising:

a centering stage configured to hold a first area of a lower surface of a substrate;

a process stage configured to hold a second area of the lower surface of the substrate;

a process-stage rotating mechanism configured to rotate the process stage about a central axis of the process stage;

an eccentricity detecting mechanism configured to obtain an amount of eccentricity and an eccentricity direction of a center of the substrate, when held on the centering stage, from a central axis of the centering stage; and an aligner configured to perform a centering operation for aligning the center of the substrate with the central axis of the process stage based on the amount of eccentricity and the eccentricity direction of the center of the substrate, held on the centering stage, from the central axis of the centering stage, wherein the process stage includes an increased diameter portion having an annular substrate holding surface for holding the second area, and a decreased diameter portion supporting the increased diameter portion, wherein the aligner obtains, after the substrate is transferred from the centering stage to the process stage and held on the process stage, an amount of eccentricity and an eccentricity direction of the center of the substrate, held on the process stage, from the central axis of the process stage by use of the eccentricity detecting mechanism; and confirms that the obtained amount of eccentricity of the center of the substrate from the central axis of the process stage is within a predetermined allowable range, wherein an upper surface of the increased diameter portion constitutes the annular substrate holding surface, and the annular substrate holding surface has an outer diameter smaller than a diameter of the substrate, and wherein an outer diameter of the increased diameter portion is gradually decreased from the upper surface which is the substrate holding surface, toward a lower surface of the increased diameter portion, and an outer diameter of the lower surface of the increased diameter portion is equal to an outer diameter of an upper surface of the decreased diameter portion.

* * * * *